US007430937B2

(12) United States Patent
Rotter et al.

(10) Patent No.: US 7,430,937 B2
(45) Date of Patent: Oct. 7, 2008

(54) RACK AND PINION STABILIZER SYSTEM

(75) Inventors: Chad Rotter, Amana, IA (US); Roberto F. T. Miller, Cedar Rapids, IA (US); Tadd Griffith, Cedar Rapids, IA (US); Michael J. Dunlap, Orion, IL (US)

(73) Assignee: Maytag Corporation, Benton Harbor, MI (US)

( * ) Notice: Subject to any disclaimer, the term of this patent is extended or adjusted under 35 U.S.C. 154(b) by 0 days.

(21) Appl. No.: 11/035,841

(22) Filed: Jan. 14, 2005

(65) Prior Publication Data

US 2005/0160854 A1 Jul. 28, 2005

Related U.S. Application Data

(60) Provisional application No. 60/536,903, filed on Jan. 16, 2004, provisional application No. 60/557,944, filed on Mar. 31, 2004.

(51) Int. Cl.
*F16H 1/04* (2006.01)
*F25D 23/00* (2006.01)

(52) U.S. Cl. ..... 74/422; 62/302

(58) Field of Classification Search ..... 74/422, 74/462, 457, 460, 437, 89.17, 409, 440; 62/382; 312/402, 334.1, 333, 404, 331
See application file for complete search history.

(56) References Cited

U.S. PATENT DOCUMENTS

| | | | |
|---|---|---|---|
| 62,860 | A | 3/1867 | Lawson |
| 90,452 | A | 5/1869 | Johnson |
| 327,104 | A | 9/1885 | Perry |
| 591,134 | A | 10/1897 | Howard |
| 657,809 | A | 9/1900 | Beebe |
| 1,067,404 | A | 7/1913 | Callaghan |
| 1,077,686 | A | 11/1913 | Duffy |
| 1,226,561 | A | 5/1917 | Mayne |

(Continued)

FOREIGN PATENT DOCUMENTS

| | | |
|---|---|---|
| DE | 19858387 | 6/2000 |

(Continued)

*Primary Examiner*—Richard W L Ridley
*Assistant Examiner*—James Pilkington
(74) *Attorney, Agent, or Firm*—Kirk Goodwin; Michael D. Lafrenz

(57) ABSTRACT

A rack and pinion stabilizer system for a refrigerator drawer. The rack and pinion stabilizer system comprises a pair of drawer glides attached to first and second liner walls of a refrigerator. Each of the drawer glides has an attached rack gear with at least one tooth having an irregular profile. A pair of gear wheels having an axle therebetween are also provided. The gear wheels are provided in rotatable engagement with the rack gears and are capable of rotating in unison. An alignment mechanism is also provided. The alignment mechanism is attached to at least one of the rack gears for providing initial alignment of the first and second rack gears with the first and second gear wheels. Additionally, a drawer in operable communication with at least one of the drawer glides and axle is disclosed. When the drawer is inserted completely within the cabinet, the first and second gear wheels are positioned over the irregular teeth, providing a tolerance permitting closure of the drawer in the event of misalignment.

24 Claims, 24 Drawing Sheets

U.S. PATENT DOCUMENTS 1,252,867 A 1/1918 Wall
1,380,688 A 1/1921 Sweeney
1,589,306 A 1/1926 Short
1,758,550 A 5/1930 Wolters
1,806,174 A 5/1931 Morin
1,902,795 A * 3/1933 Wolters ..... 312/331
2,174,181 A 9/1939 Rand
2,410,643 A 11/1946 Fielding
2,421,439 A 6/1947 Smith
2,620,253 A 12/1952 Read et al.
2,699,369 A 6/1955 Gamble
2,718,793 A * 9/1955 Hawthorne ..... 74/457
2,801,146 A 7/1957 Mikulas
3,064,491 A * 11/1962 Bishop ..... 74/437
3,323,853 A 6/1967 Stack
3,794,401 A 2/1974 Dean et al.
3,982,801 A 9/1976 Heidorn et al.
3,988,902 A 11/1976 Jacobs
4,036,073 A * 7/1977 Kitano ..... 74/393
4,051,744 A 10/1977 Oshima
4,087,140 A 5/1978 Linstromberg
4,108,016 A 8/1978 Muranishi
4,320,934 A 3/1982 Rock et al.
4,324,439 A 4/1982 Hagen et al.
4,375,907 A 3/1983 Vander Kooi et al.
4,470,642 A 9/1984 Gasperin
4,591,214 A 5/1986 Reuter et al.
4,600,254 A 7/1986 Whalen
4,615,570 A 10/1986 Goodman
4,641,406 A 2/1987 Rogers
4,879,920 A 11/1989 Kerkhoff
4,925,258 A 5/1990 Ludwig et al.
5,040,856 A 8/1991 Wilkins et al.
5,265,487 A * 11/1993 Williams et al. ..... 74/422
5,399,010 A 3/1995 McClung et al.
5,409,309 A 4/1995 Giddings et al.
5,619,388 A * 4/1997 Kawai ..... 360/85
5,664,435 A 9/1997 Bassuk
5,913,584 A 6/1999 Swindell et al.
5,944,305 A 8/1999 Takashima et al.
5,946,973 A * 9/1999 Blaha ..... 74/422
5,970,887 A 10/1999 Hardy
6,137,962 A * 10/2000 Namai ..... 396/401
6,301,981 B1 10/2001 Oechslin
6,499,818 B2 12/2002 Brustle
6,571,655 B2 6/2003 Tanaka
6,641,239 B2 * 11/2003 Kaiser ..... 312/404
6,848,759 B2 * 2/2005 Doornbos et al. ..... 312/319.1
2003/0067257 A1 4/2003 Gasser
2003/0189021 A1 10/2003 Engel
2003/0189395 A1 10/2003 Doombos et al.
2004/0035129 A1 * 2/2004 Kaiser ..... 62/302
2004/0050841 A1 3/2004 Han et al.
2004/0065579 A1 4/2004 Wood

FOREIGN PATENT DOCUMENTS

EP 0512615 A1 11/1992
EP 0718574 6/1996
JP 53-118665 * 10/1978
JP 61045480 A 3/1986
JP 3225186 10/1991
JP 5340664 12/1993
JP 5346286 12/1993
JP 6034265 2/1994
JP 6101960 4/1994
JP 200070060 9/1998
JP 11294943 10/1999
WO WO 00/36349 6/2000

* cited by examiner

RACK AND PINION STABILIZER SYSTEM

CROSS-REFERENCE TO RELATED APPLICATIONS

This application claims the benefit of related U.S. Provisional Patent Application Ser. No. 60/536,903, filed on Jan. 16, 2004, and U.S. Provisional Patent Application Ser. No. 60/557,944, filed on Mar. 31, 2004, which applications are hereby incorporated by reference.

FIELD OF THE INVENTION

The present invention relates to the art of refrigerators and, more specifically, to a rack and pinion stabilizer system and alignment mechanism for a drawer assembly of a refrigerator.

BACKGROUND OF THE INVENTION

Pullout drawers in refrigerator cabinets, and in particular bottom mounted freezer drawers, in which the freezer is located at the bottom of the refrigerator while the fresh food compartment is located at the top of the refrigerator, are often used to increase versatility of storing a wide range of food items, and increasing the accessibility of items stored in the lower portion of the refrigerator cabinet. To this end, in commercially available bottom mounted freezers a large freezer drawer or basket is provided in connection with or in place of a hinged or swinging door. These bottom mounted freezer drawers are typically mounted on slides or glides fastened to the sidewalls of the inner liner of the refrigerator cabinet and telescopically extend horizontally toward the opening or access means of the refrigerator. Unfortunately, these slides extend at different rates when the large drawer is opened and closed, particularly when the horizontal force (i.e., the consumer pushing or pulling on the drawer or basket) is not centered. The effect of the different rates of extension creates a "wobble" as the drawer or basket is extended and inserted. This door rack or wobble typically occurs when the velocity of the drawer and glide assembly varies with position along the face of the drawer as it is extended or inserted.

A further problem with such presently available systems is that typically it is difficult to ensure identical, or near identical, placement relative to the refrigerator cabinet face of left and right components comprising a drawer. A likely result of such a drawer in utilization of a rack and pinion system, particularly in a refrigerator, is the inability to completely close the drawer, resulting in the failure to create an effective seal which allows air to permeate into or out of the drawer. The inability of the drawer to completely close creates an inefficient system, making it difficult to regulate temperatures, humidity, and other factors within the drawer.

Attempts have been made, generally, in drawer systems to overcome wobble, or racking problems. For instance, anti-rack systems have been developed for drawers and drawer glides in which a shaft having a gear wheel mounted on each side is used for engaging associated racks. Moreover, though such systems prevent wobble, these attempts have not prevented the drawer from assuming a racked condition resulting from the opening force or food load center of mass occurring significantly away from the drawer's center. Likewise, no simple means of aligning left and right gear wheels to associated rack gears of a drawer in utilization of a rack and pinion system during initial assembly has been available. As a result, if the drawer, and in particular the rack and pinion system, becomes misaligned, no means exists for the correction of the misaligned drawer apart from complete disassembly and removal of the drawer from the cabinet. This task becomes particularly difficult when the drawer is filled with food or other stored items.

Complex mechanisms involving the resetting of misaligned slide pairs in a drawer suspension system have been developed. Such systems require the removal, reinsertion, and moving of the drawer in and out from the cabinet to reset the misaligned drawer. Due to the removal and reinsertion of the drawer, as well as the inward and outward movement required to reset the misaligned drawer, these systems do not provide much improvement, as the drawer must still be removed, and a significant amount of effort is required of the drawer operator to realign the drawer.

Other systems exist that involve a single displaceable gear tooth provided on the end of a rack gear for enabling meshing with a single pinion that approaches from beyond the end of the rack. The use of a single rack and pinion, however, does not provide a stable means of securing the drawer, as a minor amount of lateral force or movement of the drawer will cause misalignment of the drawer, as well as the rack and pinion, causing wobble, or resulting in jamming of the drawer.

SUMMARY OF THE INVENTION

A rack and pinion stabilizer system for a pull out drawer is provided that provides a means of avoiding wobble and racking, while at the same time providing an easy, effective means of aligning and maintaining the alignment of the rack and pinion stabilizer assembly and drawer. The rack and pinion stabilizer system may be used, for example, in connection with an appliance drawer, such as on a refrigerator drawer.

Studies have shown that left and right drawer component mounting locations vary with respect to the cabinet face due to, for example, manufacturing variances and other factors. As discussed above, these variations lead to problems in effectively closing and sealing the drawer. The rack and pinion stabilizer system reduces the probability that such variations will affect door seal.

The rack and pinion stabilizer system comprises a pair of drawer glides, a pair of rack gears provided in association with the drawer glides, a pair of gear wheels operably connected by an axle and rotatably received on the rack gears, and an alignment mechanism in association with a pullout drawer.

An appliance is thus provided. In a refrigerator, the refrigerator comprises a cabinet having an outer shell and a liner positioned within the outer shell. A drawer is positioned within the cabinet of the refrigerator. A rack and pinion stabilizer system is provided for use with the drawer. The rack and pinion stabilizer system comprises first and second slide assemblies attached directly or indirectly to first and second liner walls of the refrigerator, first and second rotatable gear wheels in operable communication with the first and second rack gears, respectively, an axle operably connected to and aligning the first gear wheel and the second gear wheel, the axle constraining the rotational and linear velocities of the drawer, and an alignment mechanism for aligning the drawer with the first and second rack gears.

Thus, the consumer is provided with a smooth operating drawer or basket for a refrigerator or other cabinet, and a simple means of aligning and maintaining the alignment of the drawer without the risk of drawer rack.

Other aspects, features and details of the present invention can be more completely understood by reference to the following detailed description in conjunction with the drawings, and from the appended claims.

DETAILED DESCRIPTION

A rack and pinion stabilizer system is provided that may be used to support a cabinet drawer, either independent from or designed as a portion of a bottom-mount refrigerator. A representative example of a commercially available bottom-mount refrigerator is the Maytag Bottom Mount Freezer Refrigerator, Model No. MBB2256G. The rack and pinion stabilizer system may be adapted to fit such a refrigerator, other types of refrigerators, refrigerator drawers, baskets or shelves, as well as other cabinets and appliances where racking, wobble and misalignment are a concern.

Figure 1:
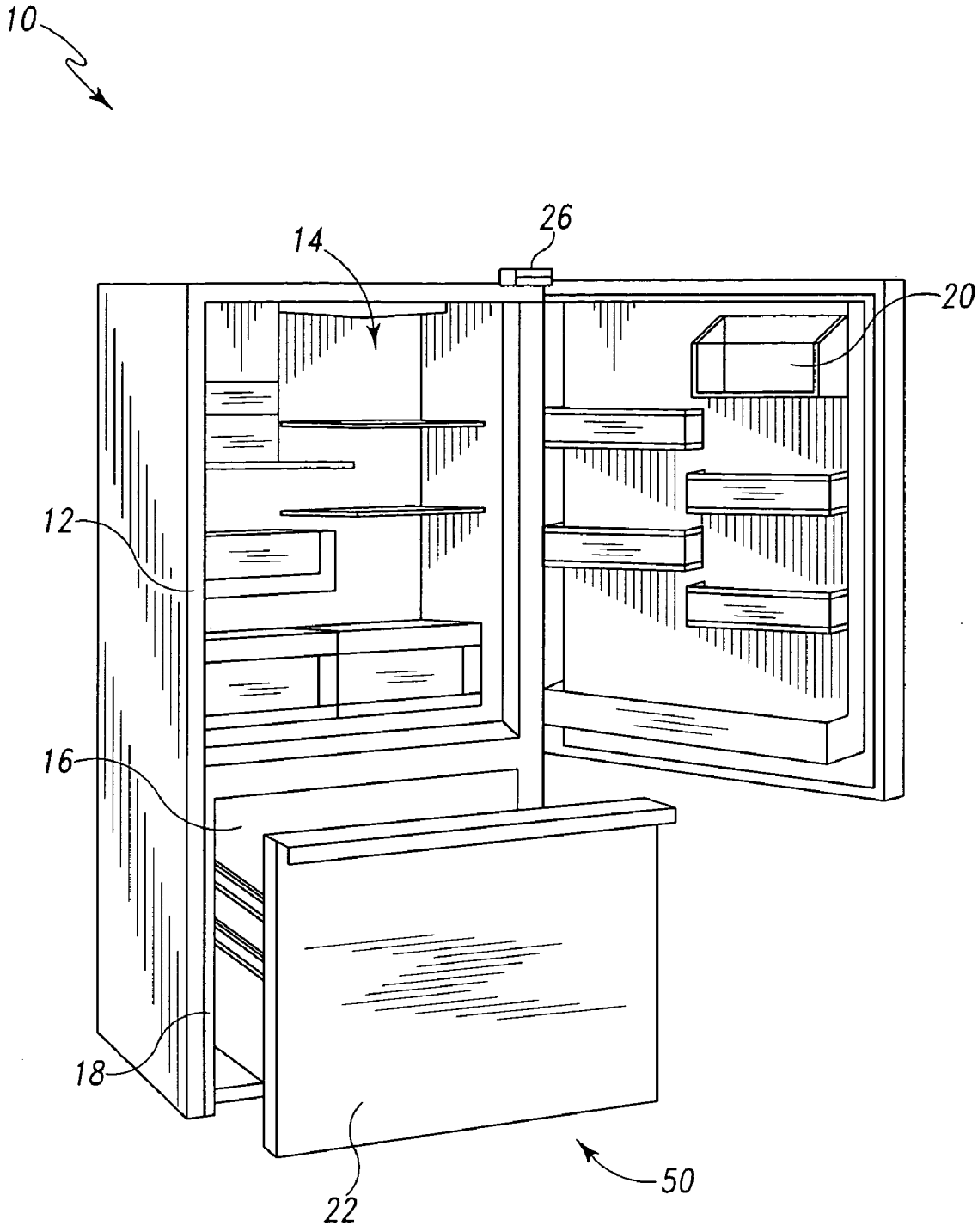
FIG. 1 is a front perspective view of a bottom mount freezer refrigerator having a pullout drawer.
Figure 2:
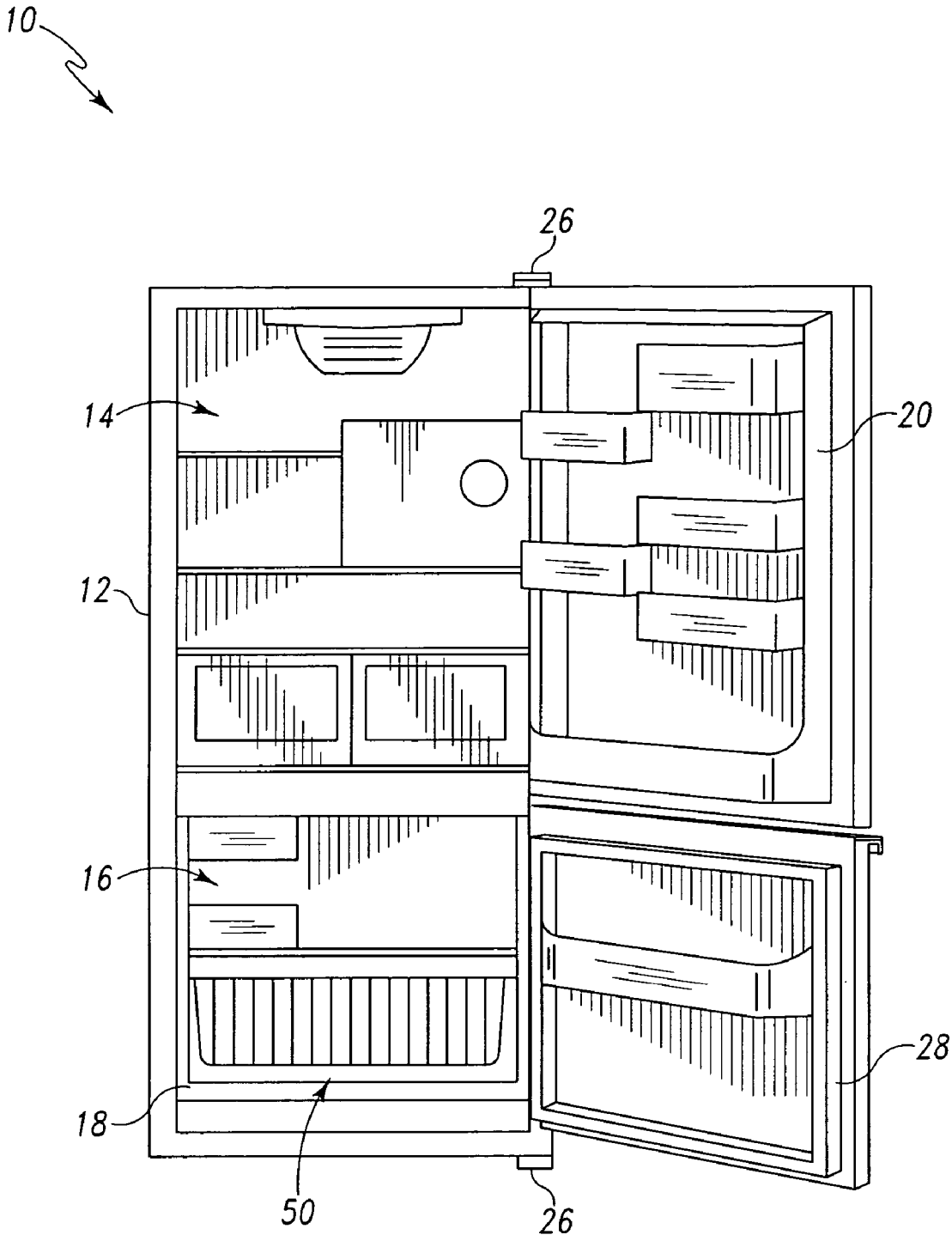
FIG. 2 is a front perspective view of a bottom mount freezer refrigerator having a freezer access door and a pullout drawer or basket.

Referring to the Figures, for ease of explanation the rack and pinion stabilizer system is shown in connection with a bottom mounted freezer of a refrigerator. However, as indicated above, the rack and pinion stabilizer system may be applied to any appliance, or drawer suitable for the purposes provided. Referring to FIGS. 1 and 2, and as is known in the art, a refrigerator 10 typically comprises a cabinet shell 12 having a top wall, a bottom wall, sidewalls, and a rear wall secured to the top, bottom and sidewalls. As shown in the Figures, the refrigerator 10 comprises a bottom-mount style refrigerator, and is therefore separated into an upper fresh food compartment 14 and a lower freezer compartment 16. The freezer compartment 16 is defined by a liner 18 positioned within the cabinet shell 12. The freezer compartment includes a pullout drawer 50 for holding items. An access door 20 is positioned across the fresh food compartment 14. Likewise, the freezer compartment 16 may be provided with a freezer access door 28, shown in FIG. 2. Alternatively, a front face 22 or wall may be provided in the place of an access door and may be fastened to the drawer 50 or basket such that the drawer 50 may be pulled out with the front wall 22 to access the freezer contents. In an embodiment comprising an access door 28, the door 28 or 20 is typically pivotally mounted on one or more hinges 26 and may include a handle for opening same. While the invention is described herein with respect to a bottom-mount refrigerator, the invention is adaptable to any suitable refrigerator system, appliance system, or cabinet system.

The basic refrigerator structure described above may be found in numerous refrigerators readily available on the market. The present invention is directed to such a refrigerator including a rack and pinion stabilizer system for use with a pullout drawer. The invention provides a rack and pinion stabilizer system for use with a pullout drawer assembly for such refrigerators.

Figure 3:
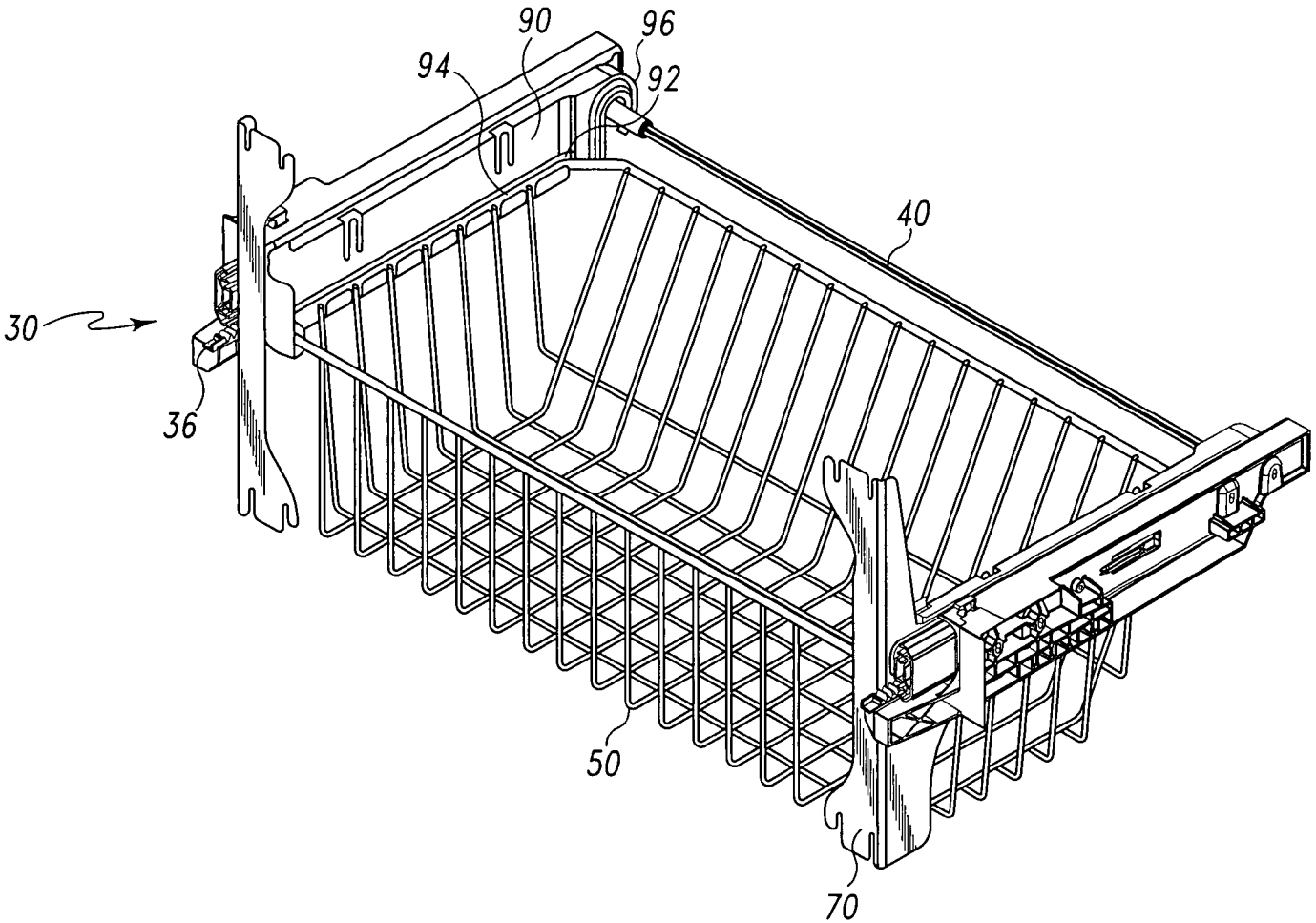
FIG. 3 is a perspective view of the rack and pinion stabilizer system in accordance with one embodiment of the present invention with an attached drawer basket and having the slide assemblies in the inserted position.
Figure 4:
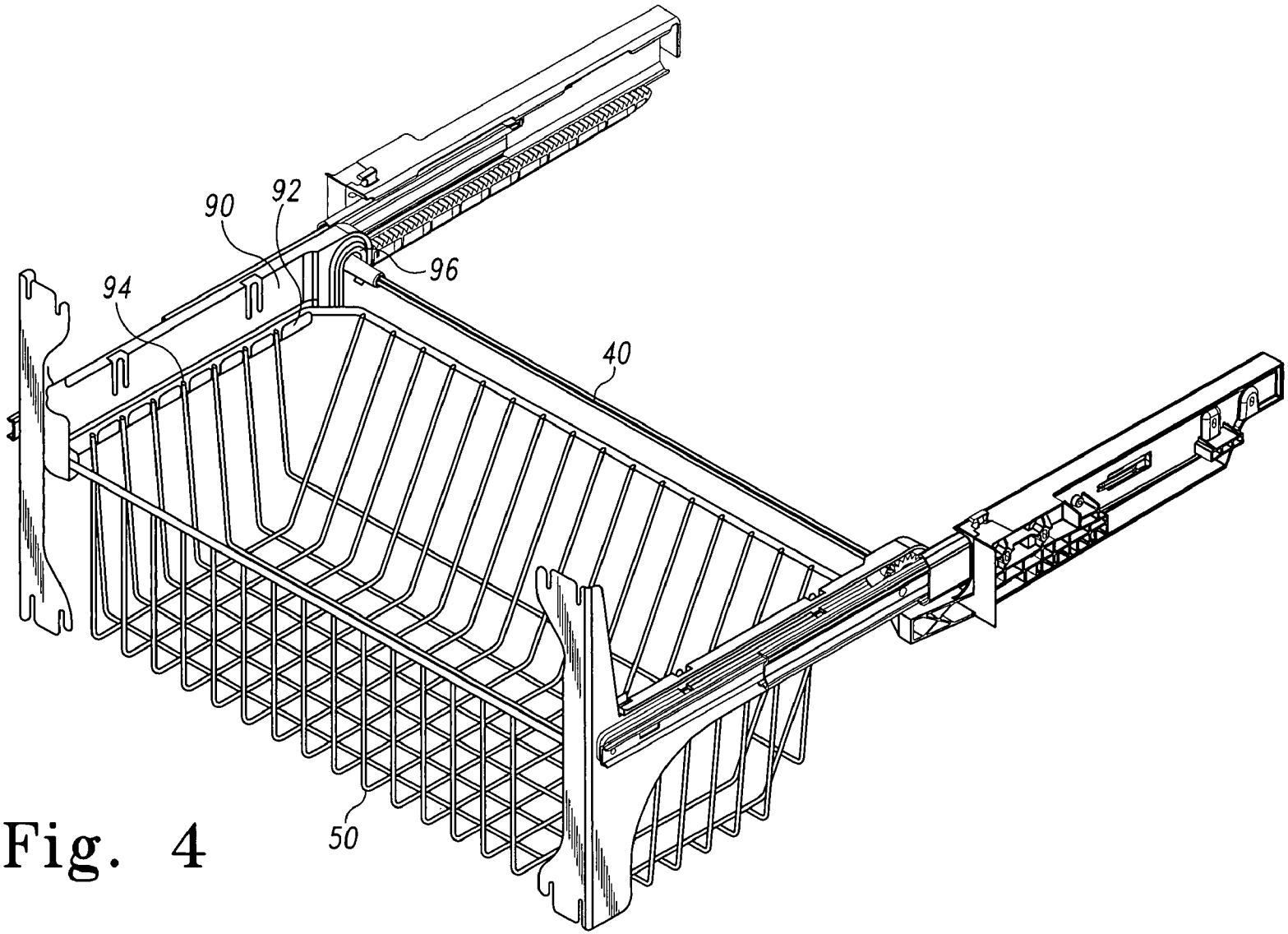
FIG. 4 is a perspective view of the rack and pinion stabilizer system in accordance with one embodiment of the present invention with an attached drawer basket and having the slide assemblies in the extended position.

As shown in FIGS. 3 and 4, a drawer 50 suitable for use with the present invention comprises a front wall, a rear wall, and first and second sidewalls. The drawer may comprise a basket, for example having a woven wire design. For the purposes of the present disclosure, "drawer" and "basket" are used interchangeably herein and the inclusion of one term is not to the exclusion of the other. The drawer or basket may be made of any suitable material for use as a drawer including, but not limited to, metal, molded plastic, and the like. Further, the drawer may be constructed by any suitable means, for example via injection molding, vacuum molding, hand or machine assembly, or other. The drawer or basket may also include one or more dividers, or other accessories. The rear wall of the drawer may be maintained at the same angle as other drawer walls, or sloped at an angle to accommodate the necessary refrigeration components housed within the lower portion of the refrigerator. Further, a single drawer may be used or multiple drawers may be used.

In one embodiment, as shown in FIG. 1, the drawer comprises a single wide or large drawer that is located in the freezer compartment of the refrigerator. The freezer drawer 50 may include a pair of vertically extending front wall attachment brackets for attaching an insulated freezer door 22 or access panel, as shown in FIG. 1. Alternatively, as shown in FIG. 2, the drawer 50 may be received within the cabinet, and may be accessed by pivotally opening the freezer door 28.

As discussed above, while freezer drawers and baskets are described, other drawers such as fresh food compartment drawers, drawers or baskets of other appliances, for example dishwashers, or furniture drawers, for example a file cabinet drawer, may be provided with a rack and pinion system of the present invention. In the embodiment of a freezer drawer, the slide assemblies of the present invention (described in more detail below) are attached to or supported by the sidewalls of the refrigerator. Drawer glides or slide assemblies for drawers are generally known. Any suitable drawer glide may be adapted to be operable with the present invention. Therefore, for purposes of the discussion herein, and for purposes of simplicity, only the relevant components and/or components unique to the slide assembly of the present invention will be referenced herein.

Figure 5:
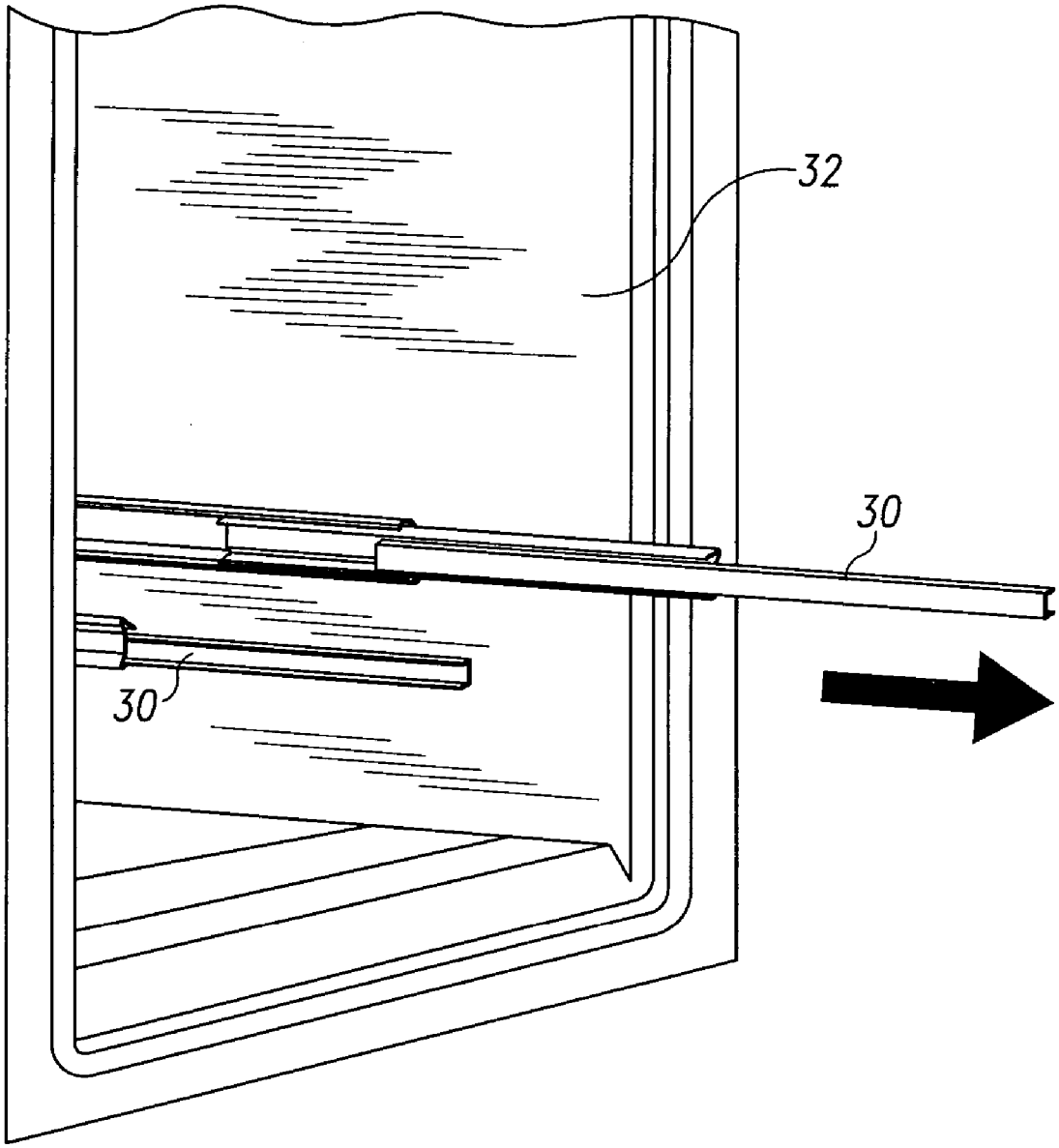
FIG. 5 is a perspective view of drawer glides used generally in a refrigerator freezer drawer.
Figure 6:
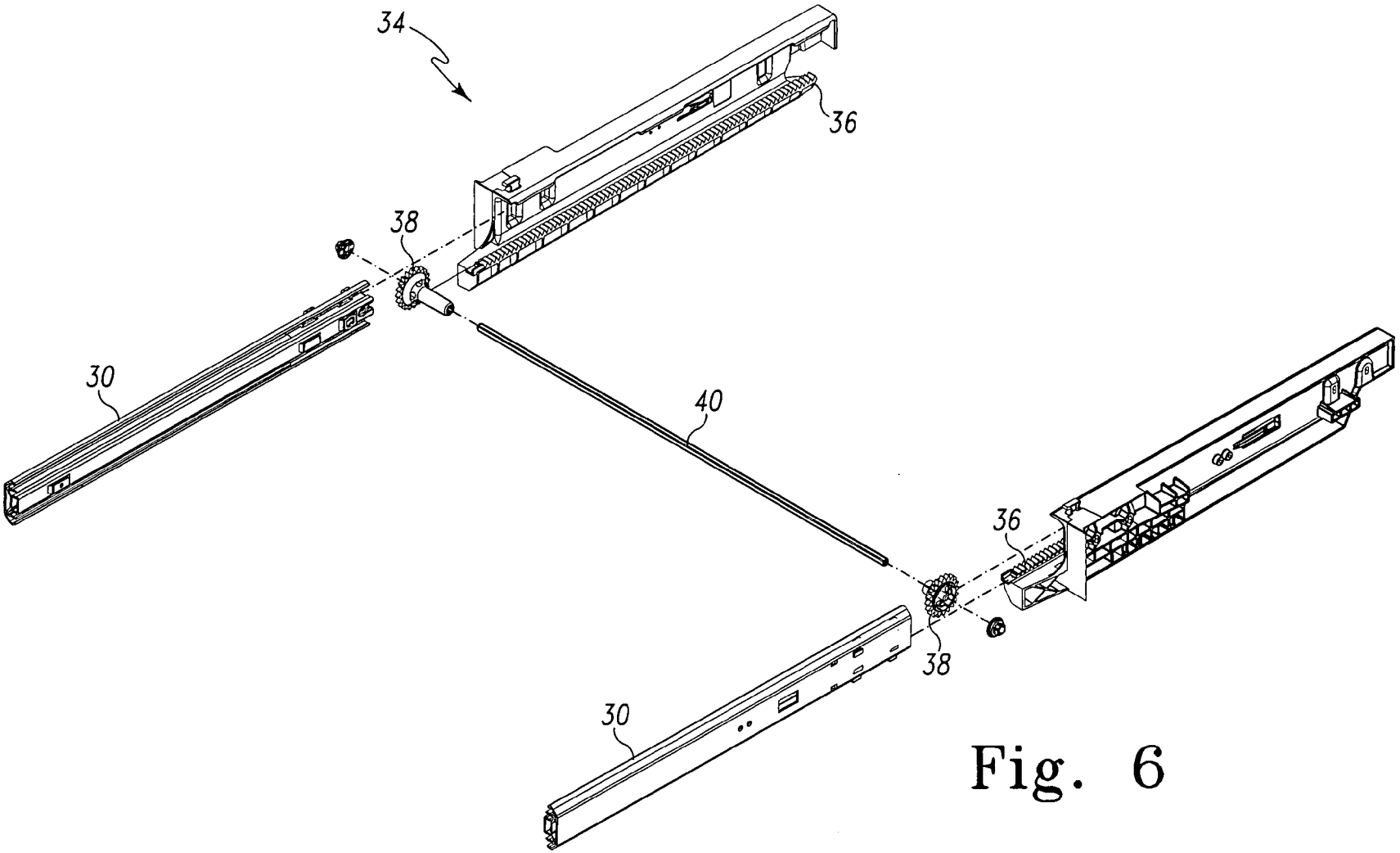
FIG. 6 is an exploded view of a rack and pinion system in accordance with one embodiment of the present invention.

In accordance with the present invention, a pair of slide assemblies or drawer glides are secured to the liner walls of the freezer area. FIG. 5 illustrates a schematic representation of a pair of slide assemblies 30 fastened to the liner walls 32 of the freezer area. For example, the slide assemblies 30 may be secured, directly or indirectly, to the inner sidewalls of the refrigerator. FIG. 6 illustrates an exploded view of a rack and pinion stabilizer system 34 in accordance with one embodiment of the present invention. The rack and pinion stabilizer system 34 includes slide assemblies 30, rack gears 36, gear wheels 38, and an axle 40. Within, attached to, or attached adjacent the slide assemblies 30 are rack gears 36. In rotatable contact with the rack gears 36 are gear wheels 38. The gear wheels 38 are linked by the transverse axle 40 for the combined rotation of the gear wheels 38 on the rack gears 36. A drawer or basket 50, as shown in FIGS. 3 and 4, may be fastened to the axle 40 and/or the slide assemblies 30. In the field of refrigeration, for example, food may be stored in the drawer 50 or basket.

Figure 7:
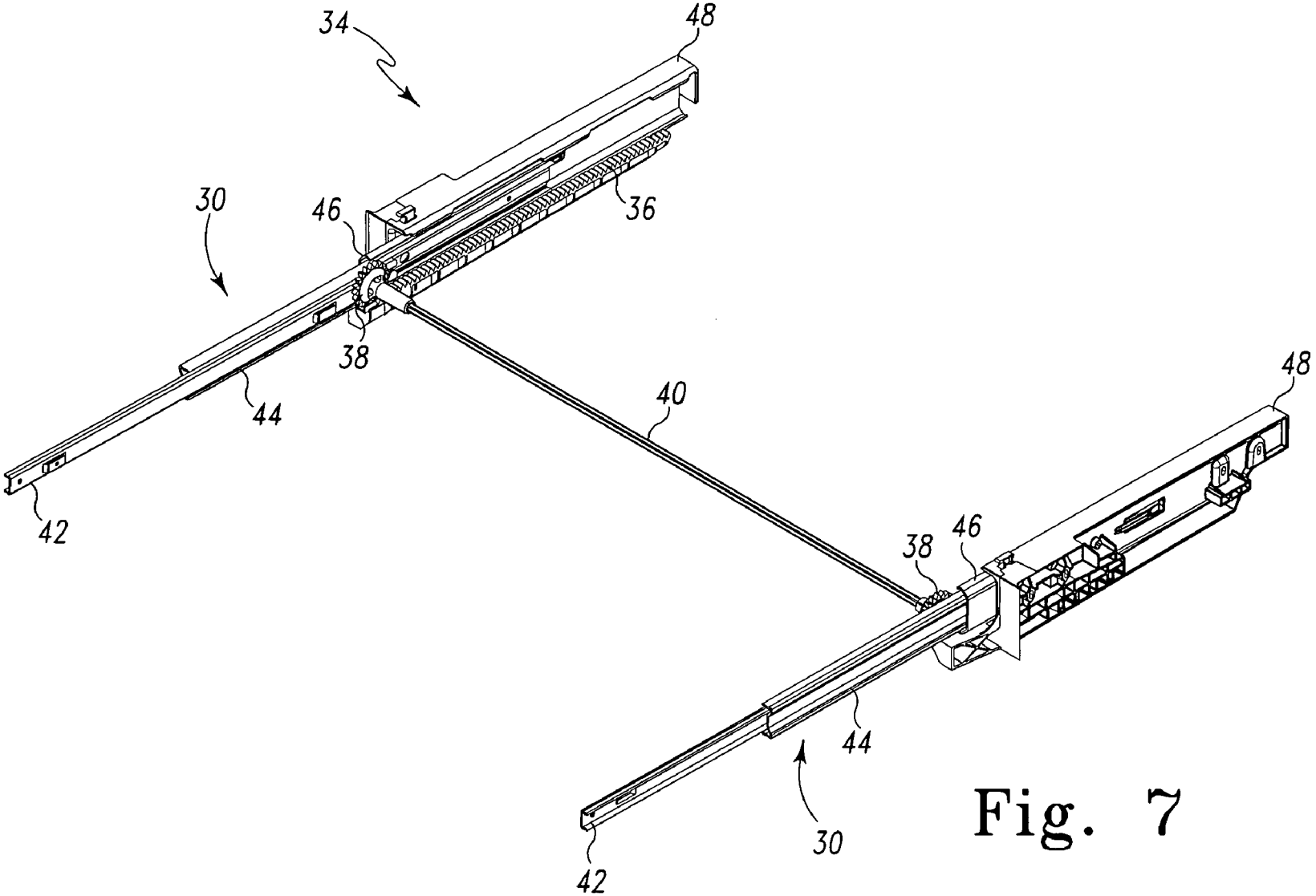
FIG. 7 is a perspective view of the rack and pinion stabilizer system in accordance with one embodiment of the present invention having the slide assemblies in the extended position.
Figure 8:
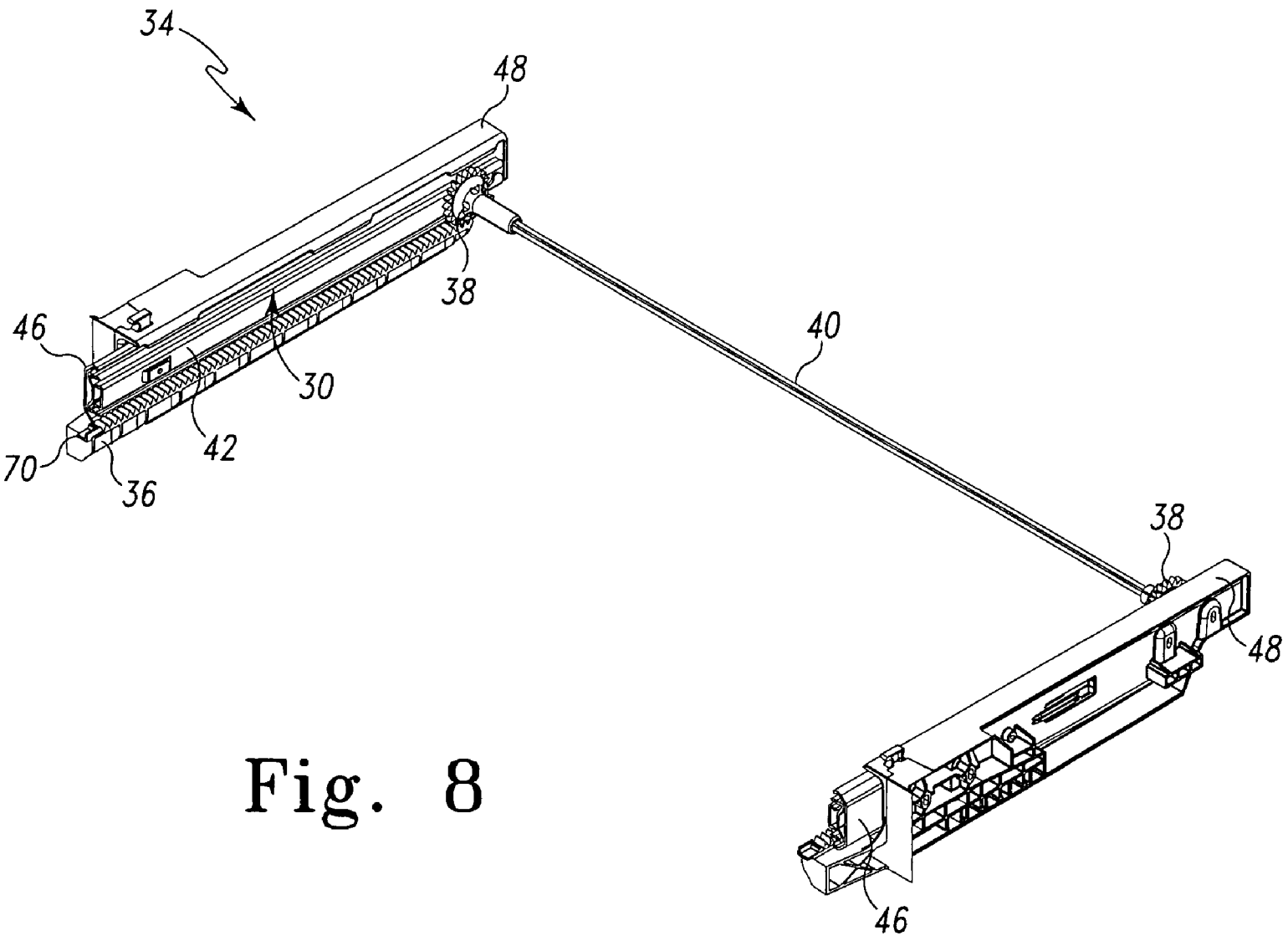
FIG. 8 is a perspective view of the rack and pinion stabilizer system in accordance with a preferred embodiment of the present invention having the slide assemblies in the inserted position.

As shown in FIGS. 6 through 8, and discussed above, the rack and pinion stabilizer system 34 comprises a rack gear 36 positioned on or proximate to a slide assembly 30. First and second slide assemblies 30 may be mounted such that, when fully extended, a portion of an inner slide member 42 and/or intermediate slide member 44 extends outwardly from the cabinet and, when retracted, the inner slide member 42 and/or intermediate slide member 44 is at least partially received within an outer channel 46 of the slide member.

A pair of gear wheels 38 or spur gears are provided in operable, rotatable communication with the rack gears 36. The gear wheels 38 are linked by an axle 40 extending horizontally between the first and second gear wheels 38. A drawer or basket 50 may be attached to the axle 40 and/or the gear wheels 38 or drawer glides, as shown in FIGS. 3 and 4. As the drawer 50 is pulled out of or inserted into the cabinet of the refrigerator, the axle 40 causes the first and second gear wheels 38 to rotate in unison along the rack gears 36. FIG. 7 illustrates the rack and pinion stabilizer system 34 in an extended or open position while FIG. 8 illustrates the rack and pinion stabilizer system 34 in an inserted or closed position. The gear wheels 38 thus have equal rotational and linear motion along the respective rack gears 36. Accordingly, drawer motion is stabilized against rack and wobble as it is extended from and inserted into the refrigerator cabinet. This system allows the drawer to be extended and inserted with a consistent and preferred orientation.

Figure 9:
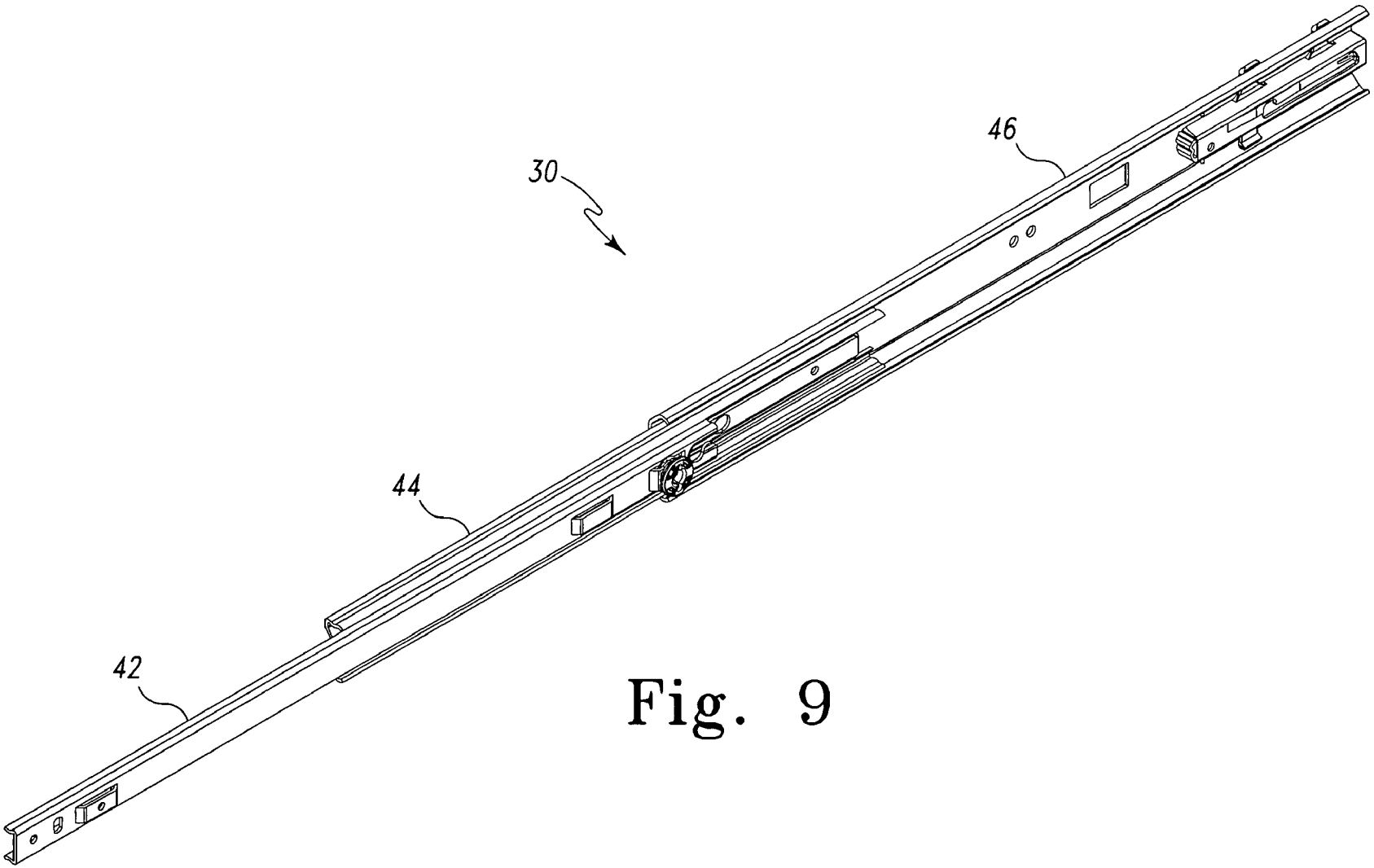
FIG. 9 is a perspective view of a slide assembly of a rack and pinion stabilizer system in accordance with one embodiment of the present invention, the assembly being in an extended position.
Figure 10:
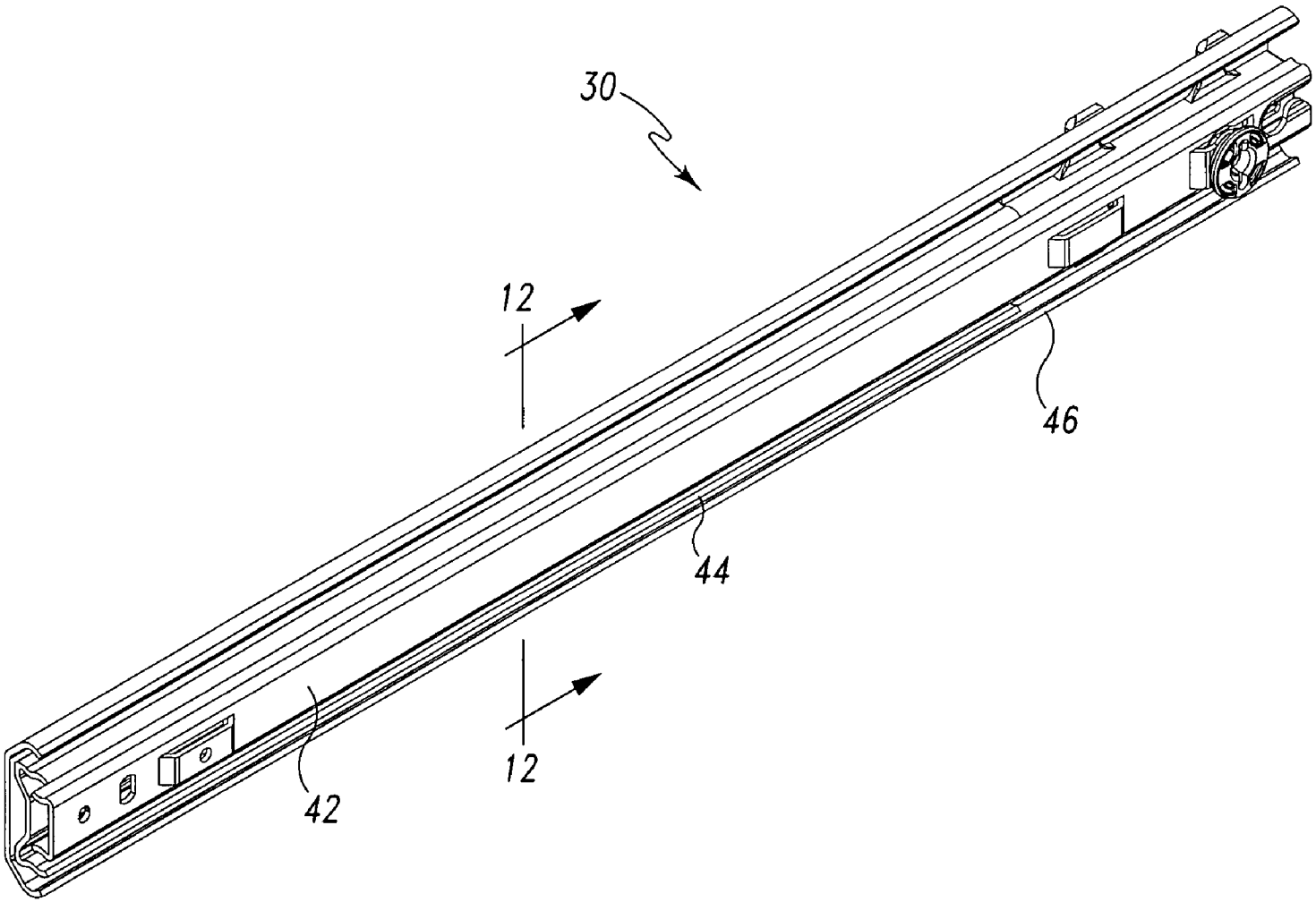
FIG. 10 is a perspective view of a slide assembly of a rack and pinion stabilizer system in accordance with one embodiment of the present invention, the assembly being in an inserted position.

The slide assemblies 30, shown in further detail in FIGS. 9 and 10 and discussed more fully below, or glides are telescopic longitudinal tracks or rails horizontally positioned and secured on the sidewalls of the refrigerator liner. The slide assemblies may have a gear assembly attached thereto. The first and second slide assemblies 30 may be mirror images of one another mounted on the opposite sidewalls of the liner. The combination of the first and second slide assemblies 30 allows horizontal movement of the attached drawer in and out of the cabinet. The slide assemblies 30 may be attached to the wall by any suitable means. Thus, for example, the slide assemblies 30 may be fastened using anchor screws, support hooks, integral molding, or other. Each slide assembly component and associated gears may be constructed of any suitable material including, but not limited to, metal and plastic. Preferably, such material provides only a minor amount of friction between the respective surfaces to allow the smooth sliding of the components. While a pair of slide assemblies and associated gear assemblies are provided as one embodiment of the invention, one, two, three, four or more such assemblies may be used in various combinations in connection with the various sub-assemblies of the present invention without departing from the overall scope of the invention. For ease of reference, the discussion herein will specifically refer to a single slide assembly and associated gear assemblies, but may apply equally to either or multiple assemblies.

Figure 11:
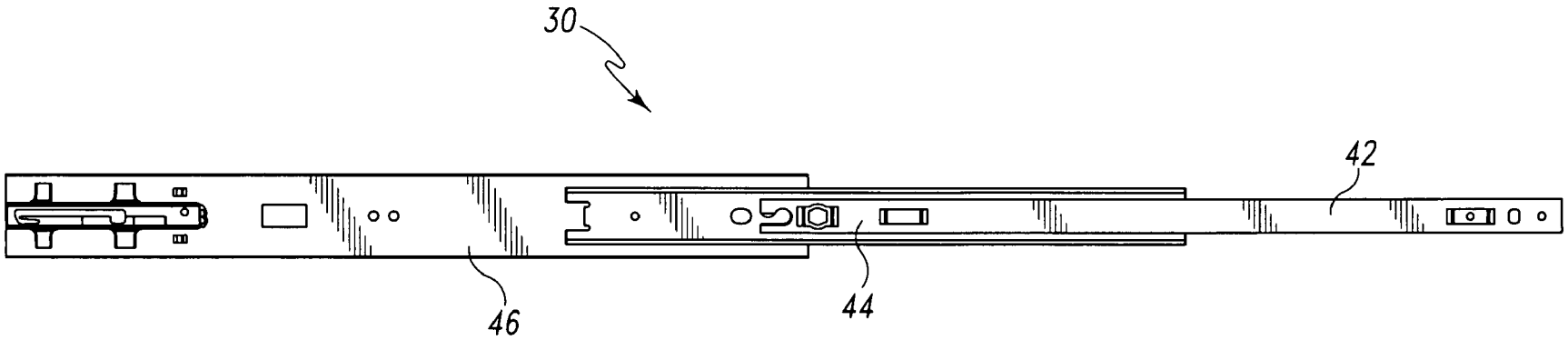
FIG. 11 is a side perspective view of a slide assembly of a rack and pinion stabilizer system in accordance with one embodiment of the present invention, the assembly being in an extended position.
Figure 12:
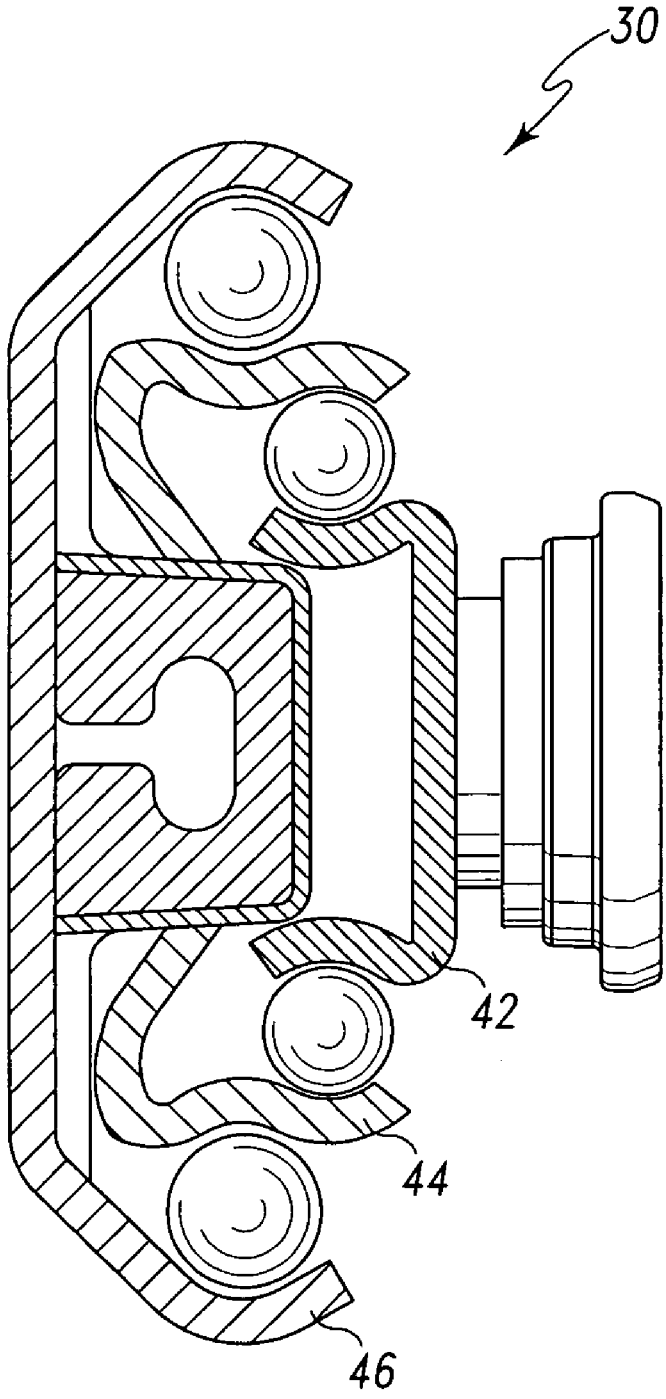
FIG. 12 is an end perspective view of a slide assembly of a rack and pinion stabilizer system in accordance with one embodiment of the present invention.

As shown in FIGS. 7 and 8, each slide assembly 30 of the preferred embodiment comprises a cabinet attachment member 48 secured to the liner wall of the cabinet, an outer channel member 46 or rail fastened to the cabinet attachment member 48, an intermediate slide member 44 slidably mounted within the outer channel member 46, and an inner slide member 42 slidably mounted within the intermediate slide member 44. FIGS. 9 through 11 illustrate the inner slide member 42, the intermediate slide member 44 and outer channel member 46 in an open position (FIGS. 9 and 11) and in a closed position (FIG. 10) FIG. 12 illustrates a side view of the slide assembly 30 with the inner slide member 42 received within the intermediate slide member 44, which, in turn, is received within the outer channel member 46. In alternative embodiments, the slide assembly may comprise fewer or more slide members. Referring to FIGS. 9, 10 and 12, the inner slide member 42 of the slide assembly 30 comprises a longitudinal rail that is shaped to be slidably and/or telescopically received within the intermediate slide member 44. Likewise, the intermediate slide member 44 is slidably and/or telescopically received within the outer channel member 46.

In an alternative embodiment of the slide assembly 30 of the present invention, the slide assembly may comprise an outer channel member 46 or rail fastened to the cabinet attachment member 48 or to the liner directly, and an inner slide member 42 slidably mounted and/or telescopically received within the outer channel member 46, absent the intermediate slide member 44. Alternatively, the inner slide member 42 (and/or, in the embodiment described above, the intermediate slide member 44) may comprise a channel that slidably or telescopically receives the outer member 46.

In the embodiments shown and described, the outer channel member 46 and the intermediate slide member 44 are substantially U-shaped to matingly receive a respective slide member. Alternately, the slide members may be provided with other shapes. For example, an L-shaped channel member may be provided for telescopically receiving a slide member. As illustrated in FIG. 7 (where the drawer is not shown) and FIG. 4, as the drawer 50 is extended, the intermediate 44 and inner 42 slide members move or slide forwardly, extending the forward end of the slide member from the outer channel member 46. Conversely, as the drawer 50 is pushed inwardly, the inner 42 and/or intermediate 44 slide members slide back into, and are received within, the outer channel member 46. Thus, the inner 42 and/or intermediate 44 slide members telescopically extend from and insert into the outer channel member 46.

Figure 13:
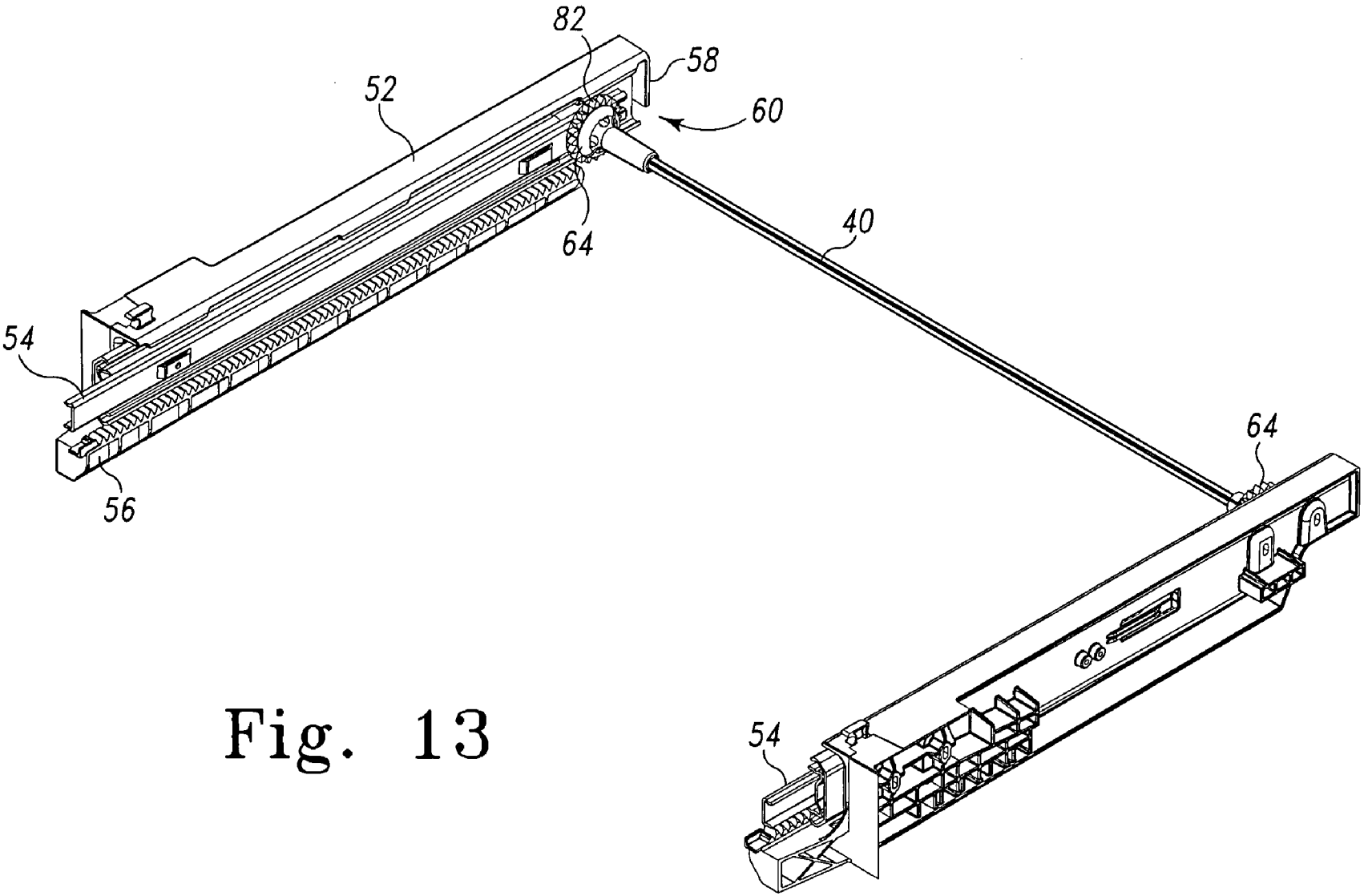
FIG. 13 is a perspective view of a rack and pinion stabilizer system in accordance with an alternative embodiment of the present invention, the slide assembly being in an inserted position.
Figure 14:
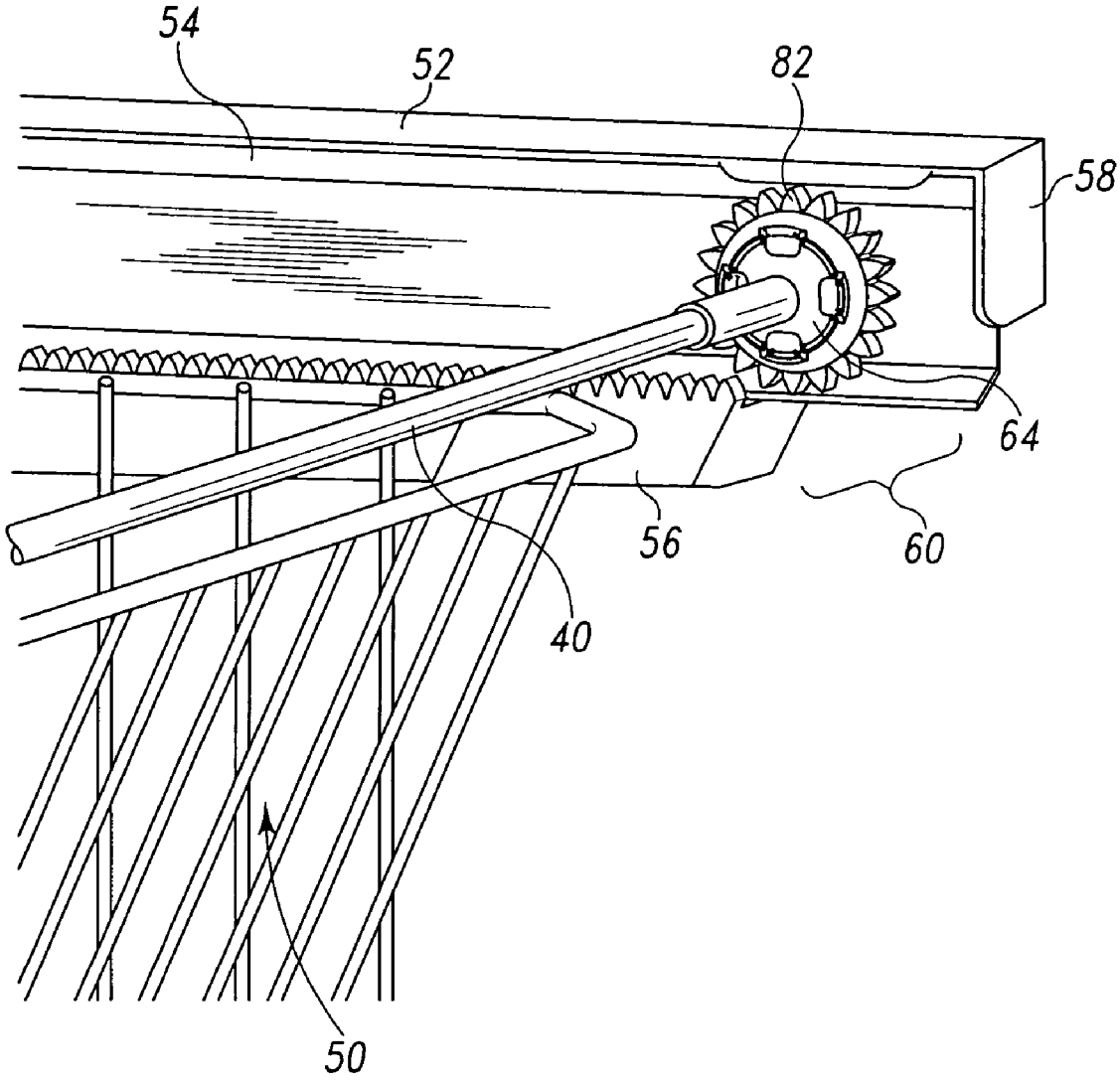
FIG. 14 is a perspective view of a portion of a rack and pinion stabilizer system in accordance with an alternative embodiment of the present invention.

In one alternative embodiment of the assembly of the present invention, shown in FIGS. 13 and 14, the slide assembly may comprise an outer channel member 52 or rail which is secured to the liner wall of the cabinet, and an inner slide member 54 slidably mounted within the outer channel member 52. A rack gear 56 is fastened to the sidewall of the freezer liner, and preferably attached near, to, or molded integrally with the lower portion of the outer channel member 52. The rack gear 56 extends longitudinally parallel with the channel member 52, but is shorter in length than the outer channel member 52 and the drawer 50. The rack gear 56 may begin at the end of the channel member 52 or slide assembly closest to the freezer door or front panel and extend back toward the rear of the refrigerator cabinet and terminal end 58 of the slide assembly. The rack gear 56 terminates prior to the terminal end 58 of the slide assembly and channel member 52. As a result, a space 60 exists between the terminal end of the rack gear and the terminal end of the channel member.

In the embodiment of FIGS. 13 and 14, the length of the inner slide member 54 is shorter than the length of the outer channel member 52 and shorter than the length of the drawer 50. Thus, when the inner slide member 54 is completely inserted into the outer channel member 52, the end of the slide member closest to the freezer door or front wall may be coterminous with or near the front end of the outer channel member 52 while the terminal end of the inner slide member 54 terminates prior to, and is spaced from, the terminal end of the outer channel member 52. The terminal end of the inner slide member 54 may coincide with the terminal end of the rack gear 56. Such uniformity, however, is not necessary for the purposes of the present invention. As a result of the location of the terminal ends of the rack gear 56 and/or the inner slide member 54, a space 60 exists between the terminal ends of the inner slide member 54 and/or rack gear 56 and the terminal end of the outer channel member 52. A gear wheel 64 is received within this space 60 adjacent to the inner slide member 54 when the drawer 50 is completely inserted. As a result, the gear wheel 64 runs or rotates along the rack gear 56 toward the front of the cabinet as the drawer 50 is extended or pulled out. At the greatest extension of the drawer 50, the gear wheel 64 may be positioned at the forward end of the rack gear 56 closest to the front wall of the refrigerator. In this position, the gear wheel 64 remains in contact with the rack gear 56. Alternatively, the gear wheel 64 may overrun the forward end of the rack gear 56. At the same time, the inner slide member 54 is fully extended from the outer channel member 52, nearly doubling the length of the slide assembly to support the attached drawer 50 or basket. Conversely, as the drawer 50 is pushed inward, the gear wheel 64 rotates back along the rack gear 56 towards the rear of the refrigerator cabinet and overruns the terminal end of the rack gear 56 as the drawer 50 reaches its resting point (fully inserted within the refrigerator cabinet). Because the drawer 50 is supported in place by the remaining components of the attached slide assemblies, the drawer 50 does not change in vertical position despite the gear wheel overrunning the rack gear. As a result, the drawer and, in particular the rack and pinion assembly, may be aligned and/or repositioned within the cabinet.

With any of the embodiments described herein, one or more of the slide members and/or outer channel members may be provided with stops and/or releasable stops (not shown). The stops may be provided on or near the front end and/or terminal end to prevent the slide member and/or gear wheel from being completely removed from the channel member or from overrunning the channel member during operation unless desired by the user.

As discussed above, and shown more clearly in FIG. 15, in the preferred embodiment a rack gear 36 is provided in connection with the slide assembly. The rack gear 36 may be fastened directly to the sidewall of the liner or may be fastened to the lower portion of the outer channel member or cabinet attachment member. For example, the rack gear 36 may be fastened to or molded integrally with the lower portion of the outer channel member 46. Alternatively, as shown in FIG. 11, the rack gear 36 may be fastened proximate, to, or molded integrally with the lower portion of the cabinet attachment member 48. The rack gear 36 extends longitudinally parallel with the channel member 46. In one embodiment, the rack gear 36 begins near the end of the channel member or slide assembly 30 closest to the freezer door or front panel and extends rearwardly toward the rear of the refrigerator cabinet and terminal end of the slide assembly 30. Further, the rack gear 36 may extend beyond the forward end of the slide assembly 30 in its retracted position, as shown in FIG. 8. In addition to the rack gear 36, an alignment mechanism 70, discussed more fully below, may be positioned at the forward end of the slide assembly 30, for example, adjacent the forward end of the rack gear 36.

Figure 17:
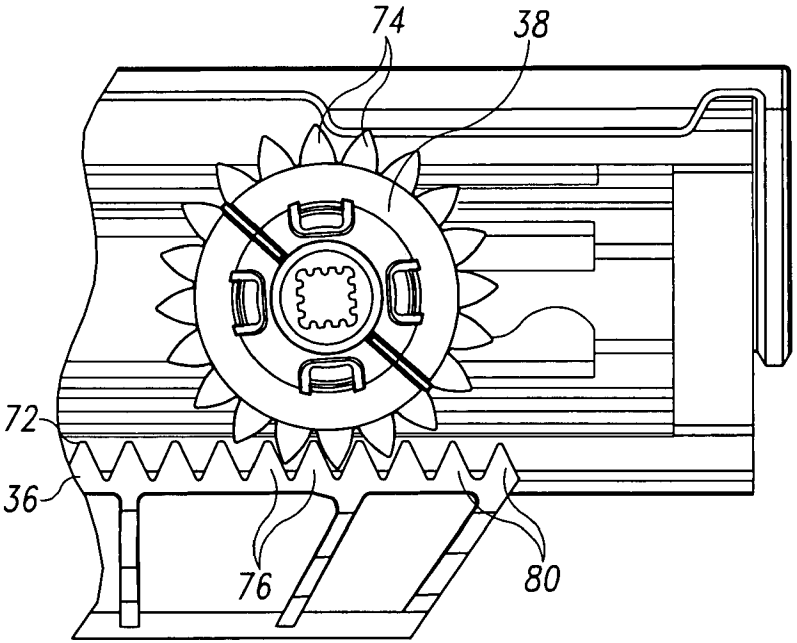
FIG. 17 is a cut away side elevational view of the terminal end of a slide assembly of an embodiment of the present invention having an irregular rack tooth profile.
Figure 16:
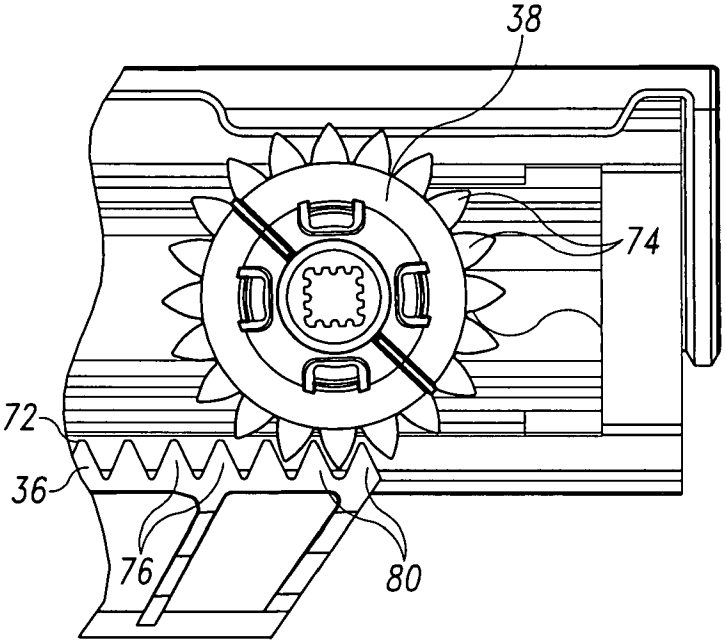
FIG. 16 is a cut away side elevational view of the terminal end of a slide assembly of an embodiment of the present invention having an irregular rack tooth profile.
Figure 18:
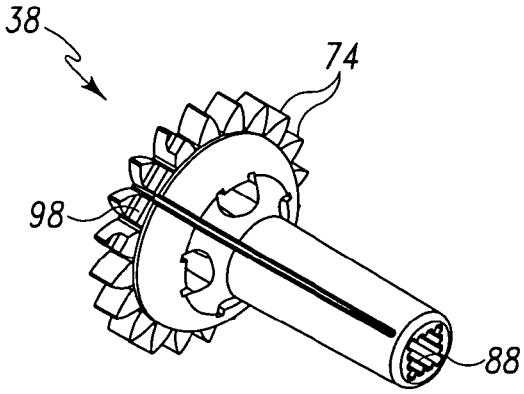
FIG. 18 is a perspective view of a gear wheel of a rack and pinion stabilizer system in accordance with one embodiment of the present invention.
Figure 19:
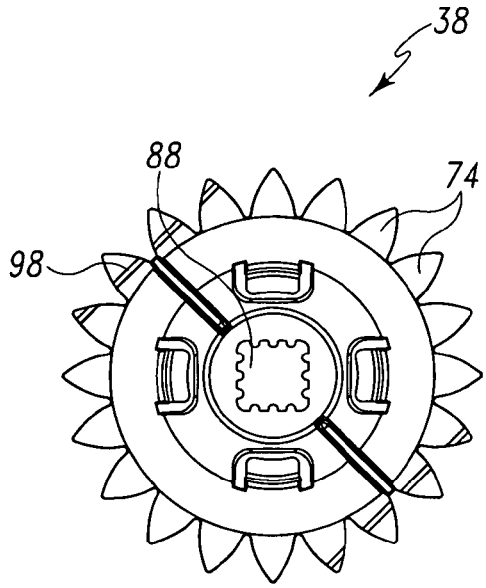
FIG. 19 is a front perspective view of a gear wheel of a rack and pinion stabilizer system in accordance with one embodiment of the present invention.
Figure 20:
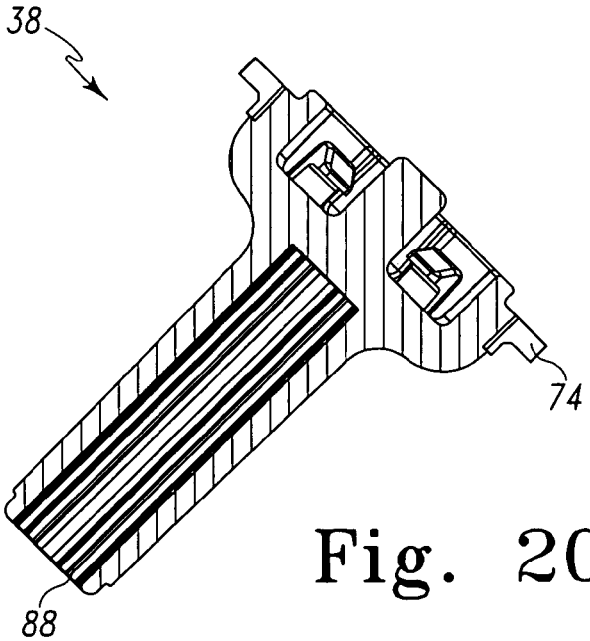
FIG. 20 is a cut away side perspective view of a gear wheel of a rack and pinion stabilizer system in accordance with one embodiment of the present invention.
Figure 21:
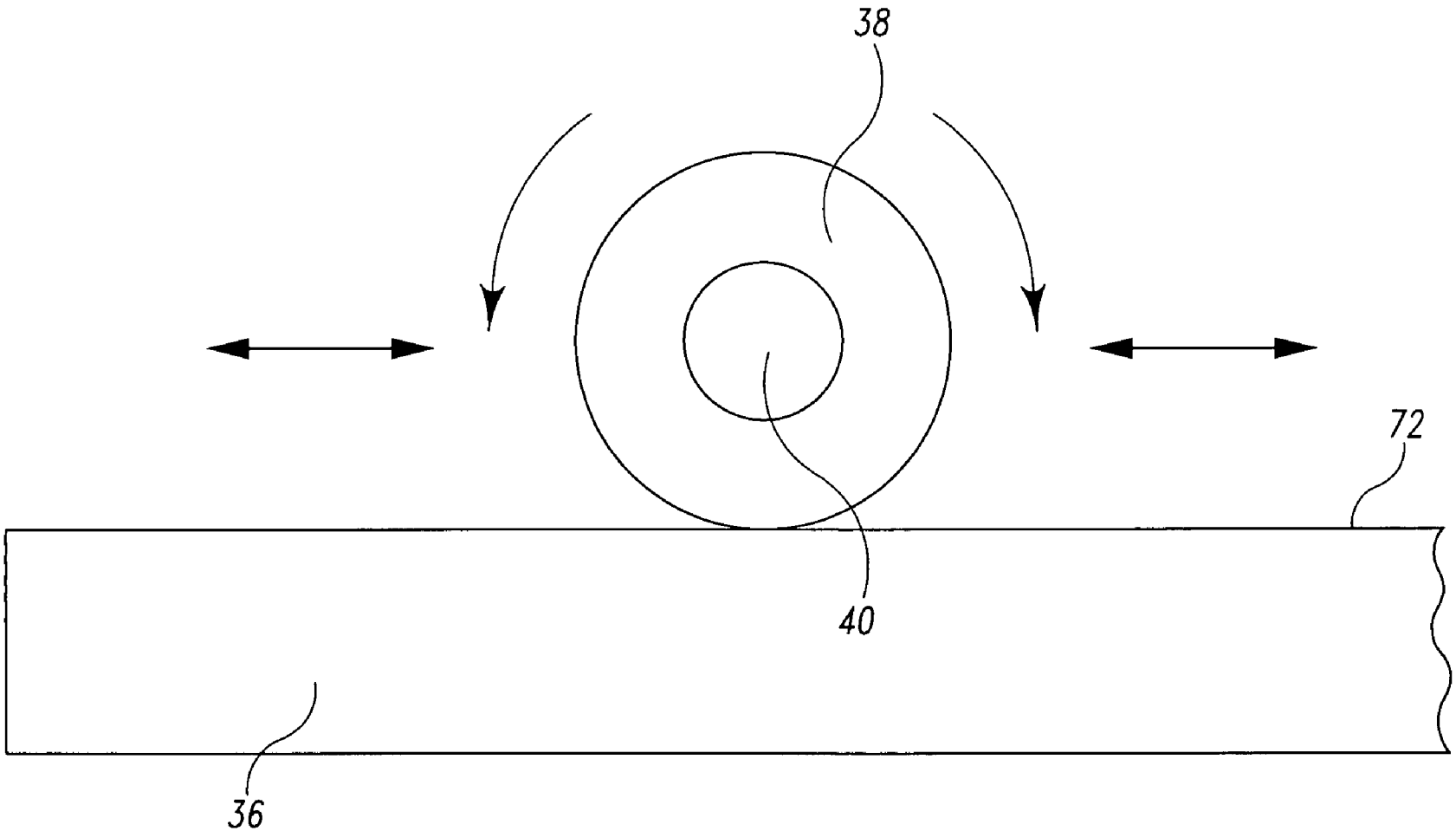
FIG. 21 is a perspective view a gear wheel and a rack gear of a rack and pinion stabilizer system in accordance with one embodiment of the present invention wherein the gear wheel and the rack gear each have a smooth surface.

As shown in FIGS. 16 and 17, in the preferred embodiment the rack gear 36 has a top surface 72 for contacting a corresponding gear wheel 38. FIGS. 18 through 20, discussed more fully below, illustrate the gear wheel 38. Preferably, the rack gear 36 may be attached to or proximate to the lower portion of the channel member 46 or cabinet attachment member 48 such that the corresponding gear wheel 38 does not extend above the top or below the bottom of the slide assembly 30, although such positioning is not required. Thus, the gear wheel 38 may be in a position that is fixed along a center line of the glide and assume a height profile comparable to the glide. The rack gear 36 may comprise a plurality of spaced apart teeth 76 for mating engagement with a gear wheel 38. The rack gear 36 may comprise a smooth surface or a tacky surface, such as a polymer or thermoplastic sheath, that creates friction to provide traction or resistance to a gear wheel 38 or pinion received on the top surface 72 of the rack gear 36 to prevent the gear wheel 38 from sliding upon the rack gear 36 or pivoting on the rack gear 36. FIG. 21 schematically illustrates a gear wheel 38 and rack gear 36 each having a smooth surface. While a top surface 72 of the rack gear 36 is specifically discussed, any surface of the rack gear 36 may be used for mating engagement with a gear wheel 38 or corresponding gear. Furthermore, the rack gear 36 may be otherwise provided, such as connected to the liner wall, or slide member of the slide assembly.

The preferred embodiment of the invention comprises a rack gear mounted as described above. The rack gear 36 may comprise a plurality of spaced apart, repeating teeth 76, which form repeating peaks and valleys along the length of the rack gear 36. A spur gear 38 is provided in rotatable contact with the rack gear 36.

As shown in FIGS. 18 through 20, the gear wheel 38 (or spur gear or pinion) comprises a circular wheel. Referring to FIGS. 16 and 17, the gear wheel 38 is operably and rotatably engaged with the rack gear 36. Preferably, the spur gear 38 comprises a gear wheel having a plurality of spaced apart, repeating gear teeth 74 surrounding the circumference of the gear to provide repeating peaks and valleys surrounding the gear. However, as indicated above, other configurations are contemplated. The gear teeth 74 of the spur gear 38 matingly engage the gear teeth 76 of the rack gear 36 so that the peak of one gear is received in a valley of the other gear. The spur gear 38 remains in constant contact with the rack gear 36. The gear wheel 38 may be constructed of any suitable material including, but not limited to, metal and plastic. The gear wheel 38 shown in FIGS. 12 and 18 is vertically oriented so that rotation of the gear wheel 38 occurs about a horizontal axis. Alternatively, any orientation or positioning of the gear wheel 38 that allows the drawer to be extended and inserted into the cabinet with the corresponding rotation of the gear wheel may be provided.

In the prior art, peaks and valleys of the gear teeth of a rack gear have typically been identical, having a common or standard profile, to provide for the uniform, smooth movement of the gears as one moves along the other. In an embodiment of a system of the present invention, at least one gear tooth 76 of the rack gear 36 may be provided with an irregular tooth profile. Preferably, as shown in FIGS. 16, 17, 22A and 22B, a pair of adjacent gear teeth 80 on the rack gear 36 may be provided with an irregular tooth profile. In this or an alternative embodiment, the final two teeth of the rack gear 36, at the rear or terminal end of the rack gear 36, may have a spacing that is slightly greater than the standard or common rack tooth profile. When the drawer is completely closed, the slide assembly 30 is fully inserted and the gear wheel 38 is positioned near the terminal end of the rack gear. Thus, in this embodiment, when the slide assembly 30 is fully inserted, the spur gear 38 rests over the valley between the last and the second to last rack teeth or the irregular shaped rack teeth (see FIG. 16). FIG. 23B, illustrates an alternative embodiment of a rack gear 36 having at least one tooth 84 or valley with an irregular tooth profile for mating with a tooth 86 of a gear wheel 38 having an irregular tooth profile. It is contemplated that one, two or more gear teeth and/or valleys may be provided with an irregular profile, may be provided in different locations along the gear, may be adjacent or separate, or may be provided on the gear wheel without departing from the overall scope of the invention.

Preferably, each peak of a rack gear tooth has an inward or rearward facing surface and an outward or forward facing surface. The rearward facing surface is the point of contact, and the driving force of spur gear rotation across the rack gear as the drawer is pulled out of the cabinet, while the forward facing surface remains idle. Thus, for purposes of illustration, the rearward faces of the rack teeth will be termed the "drive side" as they force the rotation of the gear wheel during drawer opening. The opposite surface of the valley, or the forward faces of the rack teeth, will be termed the "idle-side." As indicated above, Referring to FIGS. 16, 17, 22A, and 22B, tooth clearance may be increased in the final two valleys of the rack teeth on both left and right sides by alterations in the rack tooth profiles on each side of the valley providing a tolerance to the system. In order to alter the rack tooth profiles, either or both of the drive side and idle-side may be modified. In one embodiment, the drive sides of the relevant rack teeth are minimally modified or not modified while the idle-sides of the relevant rack teeth are modified to a greater extent. This embodiment permits smooth operation of the drawer as it is extended from the cabinet and permits gear tooth clearance permitting alignment and/or drawer closure. In one embodiment, the variation in the tooth profile drive-side surface is identical for the last two rack gears, while the variation in the idle-side surface is slightly greater on the final rack gear tooth than the tooth prior to the final rack gear tooth. Thus, for example, using a typically tooth profile, the first and second drive sides are offset 0.005 inches, while the first idle-side is offset 0.20 inches and the second and final idle-side is offset 0.010 inches. As a result, a slight amount of play or tolerance in the movement of the spur gear tooth within the valley of the rack gear is provided. Because the idle-side surface is provided with a slightly greater set back than the drive-side surface, more movement or tolerance is provided in the gear assembly as the drawer is pulled forward. As a result of the irregular tooth profiles, the drawer will close completely despite problems in alignment, as a minor amount of movement is available for each spur gear in the closed position of the drawer.

Returning to FIGS. 7 and 8, the gear wheel 38 rotates along the rack gear 36 toward the front of the cabinet and/or assembly as the drawer is extended or pulled out. At the greatest extension of the rack and pinion assembly, the gear wheel 38 may be positioned at the forward end of the rack gear 36 closest to the front of the refrigerator or appliance, as shown in FIG. 7. At the same time, the intermediate 44 and inner slide 42 members are extended from the outer channel member 46, increasing the length of the slide assembly 30 for support of the attached drawer or basket, as shown in FIG. 4. Conversely, as the drawer is pushed inwardly, the gear wheel 38 rotates along the rack gear 36 towards the rear of the assembly or refrigerator cabinet to the terminal end of the rack gear 36, and the members of the slide assembly 30 are telescopically received within the outer channel member 46 as the drawer reaches its resting point fully inserted within the refrigerator cabinet, as shown in FIGS. 3 and 8.

Figure 24:
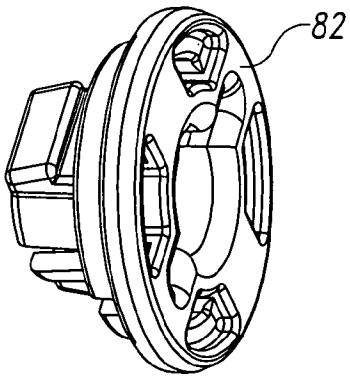
FIG. 24 is a perspective view of a bushing of a rack and pinion stabilizer system in accordance with one embodiment of the present invention.
Figure 25:
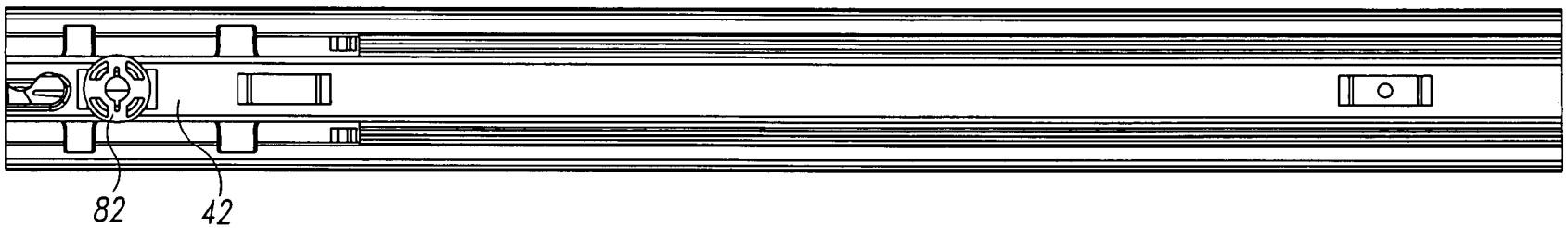
FIG. 25 is a perspective view of a bushing attached to an inner slide member of a rack and pinion stabilizer system in accordance with one embodiment of the present invention.

In one embodiment, a bushing 82, shown in FIG. 24, is attached to the inner side of the center of the gear wheel 38. As shown in FIG. 25, the bushing 82 may be fixed to the inner slide member 42. The gear wheel 38 is rotatably connected to the slide assembly 30 on the side facing away from the axle 40 by means of the busing 82. The bushing 82 allows rotation of the gear wheels 38 and axle assembly 40. Alternatively, the gear wheel 38 may be fastened directly to the slide assembly 30 absent a bushing or rotatable connection means. (See also FIGS. 18-20).

Referring to FIGS. 6 through 8, a first end of the axle 40 is attached to the first gear wheel 38, and therefore to the first slide assembly 30. The axle 40, or drive shaft, may comprise a longitudinal, squared rod. Any suitable axle, shape, and material composition, such as metal, wood or plastic may be used. The second end of the axle 40 is connected to the second gear wheel 38, and therefore to the second slide assembly 30. In one embodiment, the gear wheels 38 are pressed on the ends of the axle 40. The axle 40 extends horizontally between the first and second slide assemblies 30, substantially perpendicular to the orientation of the slide assemblies 30, linking the first and second gear wheels 38 together. In an embodiment for use in a refrigerator cabinet, the axle 40 extends horizontally across the refrigerator cabinet. In such embodiment, the axle 40 may extend across the refrigerator cabinet between the gear wheels 38 at the rear of the drawer or basket, although such positioning is not required. The axle 40 may also comprise a shaft which is a telescoping assembly, or may comprise means of slidably moving the gears and associated components. Alternatively, the axle 40 may be located in other positions, such as below, above or in front of the basket or drawer. Further, the axle 40 may be secured directly to the drawer or basket.

Referring again to FIGS. 3 and 4, an outer casing 90 may be provided over the slide member or a portion of the slide assembly 30. The outer casing 90 provides an aesthetically pleasing appearance, but may also function to support the basket or drawer 50 on the drawer slide assemblies 30. The outer casing 90 contains a channel 92 or groove on a surface thereof. The groove 92 is sized to receive and support a corresponding side of or lip 94 of the basket or drawer 50. A housing 96 for the gear wheel is provided at the rear of the casing 90. The housing 96 may fasten the axle 40 or gear wheel to the drawer 50 in operable communication, so that by exerting force on the drawer 50 to pull the drawer 50 out of the cabinet or insert the drawer 50 into the cabinet, the assembly of gear wheels and axle 40 move in unison with the drawer 50. At the same time, the axle 40 is kept in the same relative position with respect to the location of the drawer 50. However, any suitable means of attaching the drawer to the axle and/or gears or linking the operable movement of the drawer and the axle and/or gears may be used.

As shown in FIG. 8, the spur gear teeth may be mated with the rack gear teeth in conjugate action throughout the entirety of drawer travel. To assist in the positioning of the drawer, an alignment system 70 may be provided. The alignment system provides a means to correct variations in drawer alignment due to production and/or manufacturing variances. In addition to, or as an alternative to the irregular gear tooth profiles discussed herein, one or both spur gears 38 may be provided with an opening 88, shown in FIGS. 18-20, 23B and 27, designed to allow a preset value of angular slip. For example, the opening 88 may be sized such that an end of the draft shaft or axle 40 connecting the two spur gears 38 may fit within the opening 88. The opening 88 in the spur gear 38 permits a degree of angular slip of the drive shaft 40 within the opening 88, enabling the system to tolerate production variation with regard to drawer alignment.

Figure 26:
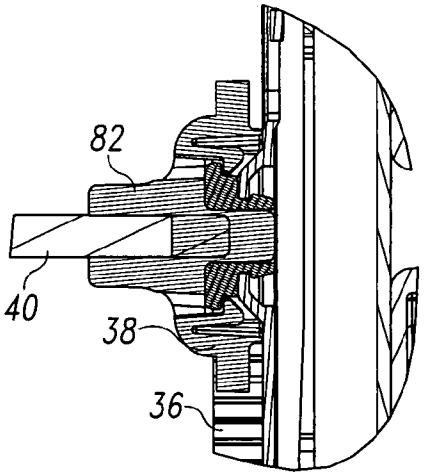
FIG. 26 is a side perspective view of a drive shaft received within the center of a circumference of a gear wheel of a rack and pinion stabilizer system in accordance with one embodiment of the present invention.
Figure 27:
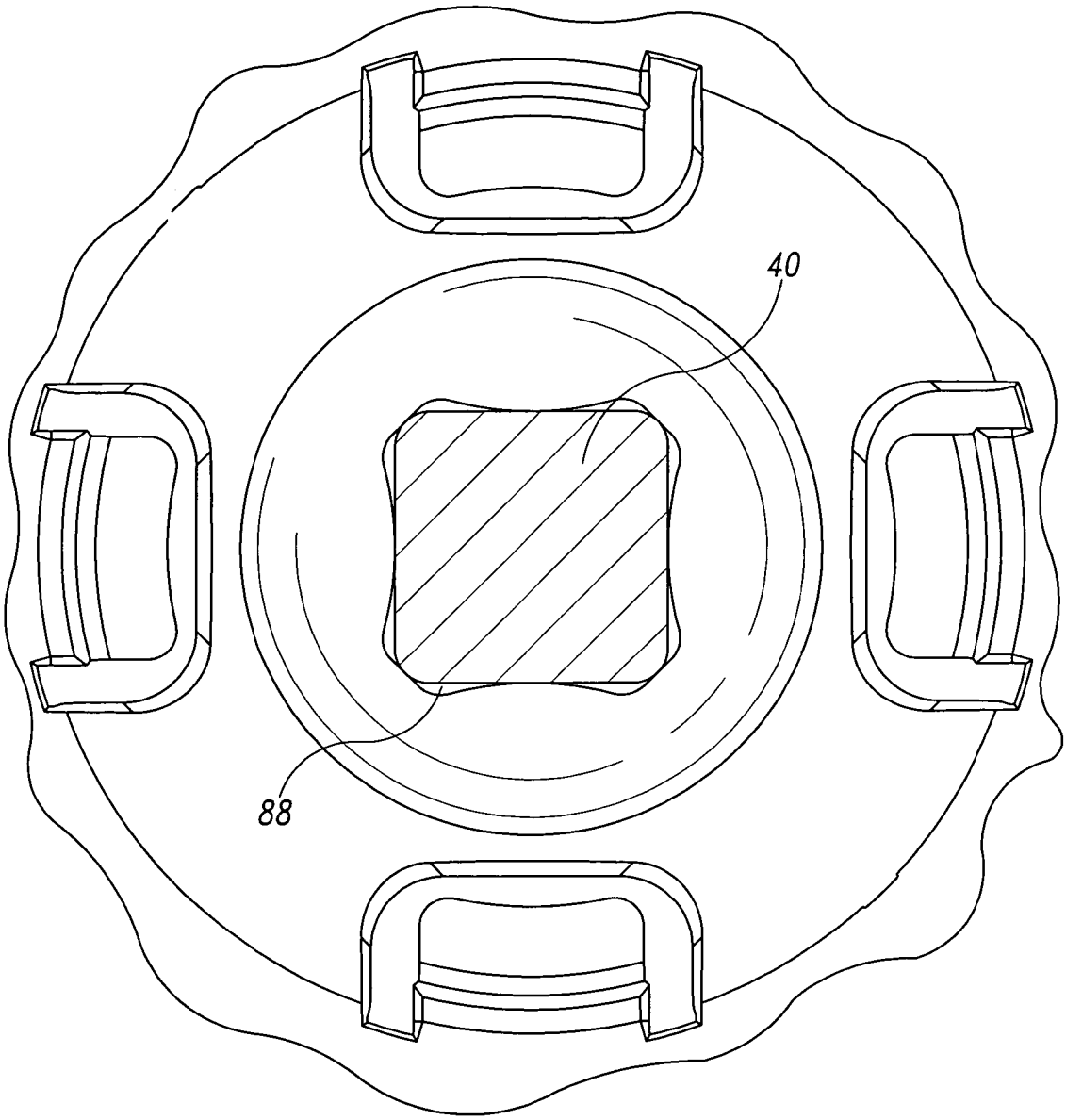
FIG. 27 is a close up cut away elevational view of an embodiment of a gear wheel or spur gear having angular slip capability.

As shown in FIGS. 23B, 26 and 27, the drive shaft 40, or axle, may comprise a substantially squared shaft having slightly rounded corners. The drive shaft 40 is received within the center of the circumference of the spur gear 38, for example in a drive shaft receptor, allowing uniform rotation of the spur gear 38 about the axis created by the drive shaft 40. The receptor may be shaped in a manner that provides spacing or separation adjacent each corner of the drive shaft on both sides of the drive shaft. Each spacing is shaped to correspond with the corners of the drive shaft. For example, for receiving rounded corners of a drive shaft, the spacing may be slightly rounded. The shaping of the spacing and the shaping of the corners of the drive shaft permit an amount of lateral movement or slidable interaction at each corner of the drive shaft. As a result, the drive shaft may rotationally slip within the spur gear, pivoting over a horizontal axis. Preferably, the drive shaft can rotate between an infinite number of positions between a forward pivot point and a rearward pivot point defined by the contact of the drive shaft with the walls of the receptor. At the greatest degree of angular slip or rotation, one side adjacent a corner of the drive shaft may be flush with one side of the drive shaft receptor, while the opposite side comprises a larger spacing between the drive shaft and the wall of the receptor. The position shown in FIG. 27 is the central position of the drive shaft between the forward and rearward pivot points. As a result of the angular ship, a tolerance is provided allowing for variations in positioning of the respective rack and pinion and/or slide assembly components.

In connection with, or separate from, a spur gear 38 providing a degree of angular slip, a spur gear tooth 86 may be provided, as discussed previously, which comprises a different profile and/or height than the standard or common spur gear tooth profile of the gear wheel 38 (see FIG. 23B). Thus, a spur gear tooth 86 may be included having a unique profile that will mate only with a corresponding rack tooth 84 configuration, repeating equidistantly to one spear gear revolution. A plurality of raised rack gear valleys for receiving the differing profile spur gear tooth may be provided at intervals corresponding to a complete rotation of the spur gear along the rack gear. While a single differing spur gear tooth profile and corresponding raised rack gear valley are specifically described, a plurality of such differing tooth configurations and corresponding raised gear valleys may be used on either the rack gear or the spur gear. The unique tooth profile provides for a specific alignment of the rack and pinion assembly for operation, thereby avoiding drawer rack and/or wobble.

Figures 22A, 22B:
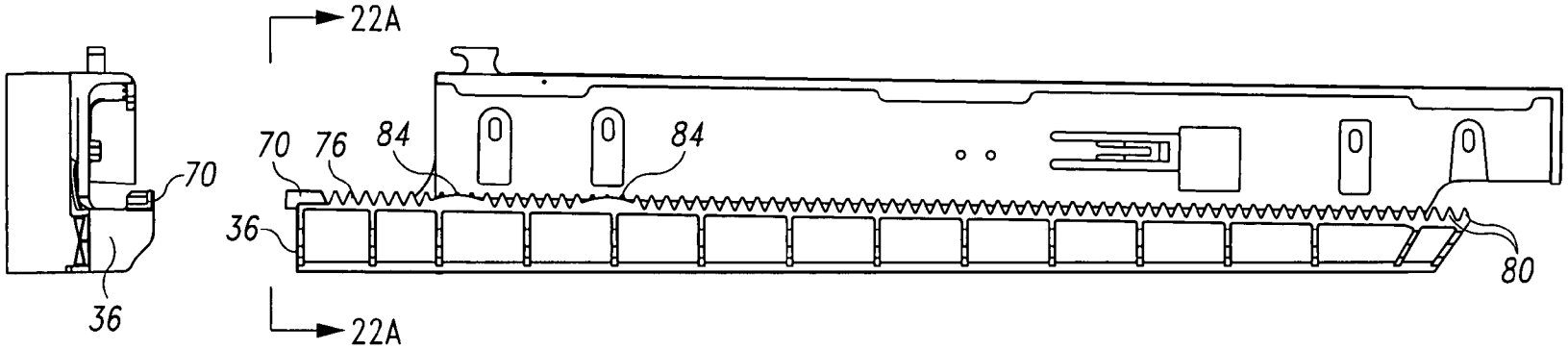
FIGS. 22A & 22B are an end view and a side view of a rack and pinion stabilizer system in accordance with one embodiment of the present invention wherein the rack gear includes an irregular tooth profile.
Figure 23A:
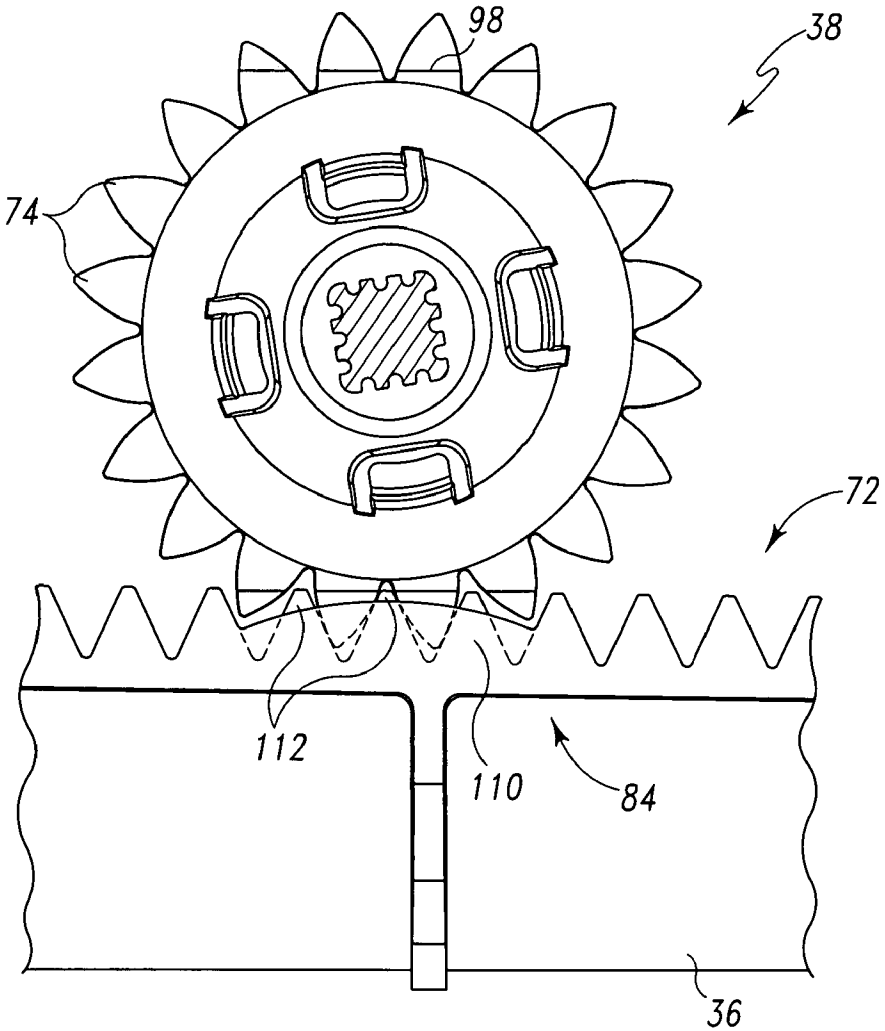
FIG. 23A is a close up cut away elevational view of a gear wheel of a rack and pinion stabilizer system in accordance with one embodiment of the present invention, wherein the gear wheel has a planar surface and the rack gear has an irregular rack profile.
Figure 23B:
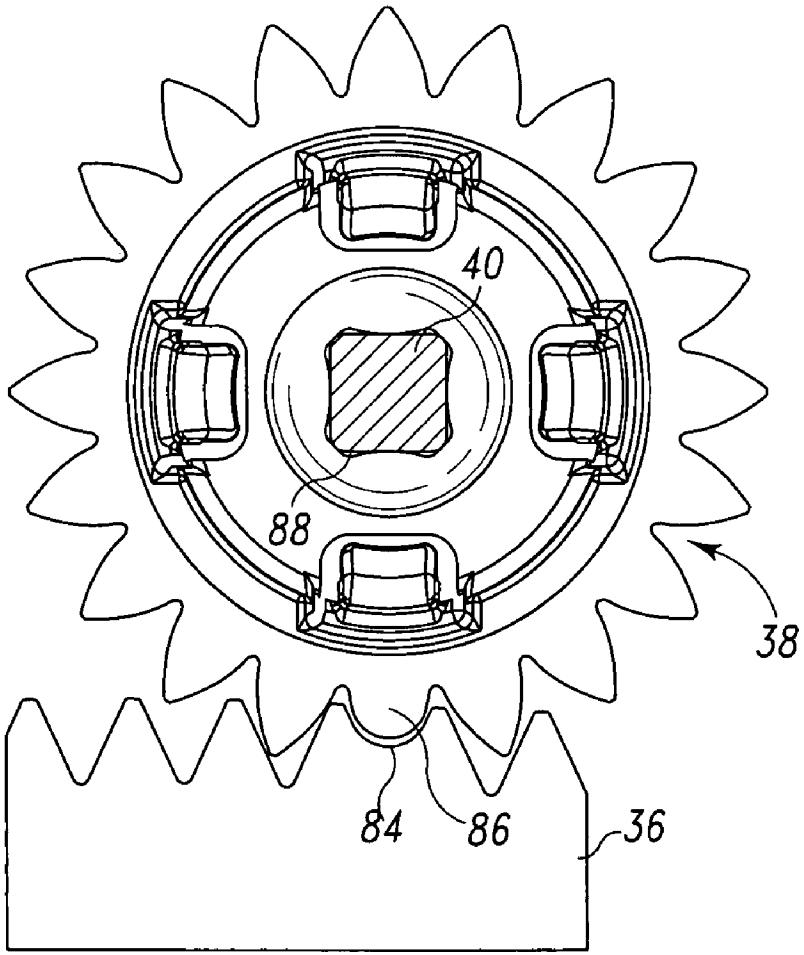
FIG. 23B is a close up cut away elevational view of a gear wheel of a rack and pinion stabilizer system in accordance with one embodiment of the present invention wherein the gear wheel has angular slip capability and an irregular tooth profile, a corresponding irregular tooth profile being provided on the corresponding rack gear.

Referring to FIGS. 22A, 22B, and 23A, in a preferred embodiment of the rack and pinion stabilizer system of the present invention a gear wheel 38 is provided (discussed in further detail herein below) that is configured with at least one flat surface 98 created by altering the geometry of four adjacent teeth 74. In one embodiment, the gear wheel 38 includes two such flat surfaces 98. Thus, four adjacent spur gear teeth are modified to form a planar surface 98. Spur gear teeth 74 forming the planar surface 98 may include a portion comprising an unmodified gear tooth having a height and profile corresponding with the standard or common gear teeth surrounding the circumference of the spur gear and an alignment portion or planar surface 98 having a reduced height and a flat top surface. Thus, a single gear tooth 74 comprises, for example, a complete gear tooth peak and a flat contact surface.

In addition, a rack gear 36 is provided having an irregular tooth profile or differing tooth configuration 84. This irregular profile tooth configuration 84 is spaced a distance from the forward portion of the rack gear 36, as can be seen in FIG. 22B. Further, more than one such configuration 84 may be used in association with the assembly of the present invention on either corresponding rack gears and/or on a single rack gear. In a preferred embodiment, two rack gears 36 are provided each having two such irregular profile gear tooth configurations 84. Preferably, the irregular profile configuration 84 comprises an arched portion 110 and an adjacent toothed portion 112. The arched portion 110 preferably corresponds to a length of a plurality of gear teeth, and more preferably between three (3) and five (5) gear teeth, although any length suitable for the purposes provided herein would be acceptable for purposes of the present invention. The toothed portion 112 preferably comprises a series of gear teeth corresponding in height and distance apart, or profile to the remaining teeth of the rack gear 84. The arched portion 110 is positioned on a portion of the rack gear 36 corresponding with the position of the planar surface 98 of the gear wheel 38 when engaged with the rack gear. The toothed portion 112 of the irregular tooth profile 84 is positioned on a portion of the rack gear 36 adjacent to the arched portion 110 and corresponding with the position of the unmodified portion of the gear teeth forming the planar surface on the gear wheel 38 when engaged with the rack gear. As a result, the planar surface 98 of the gear wheel contacts the arched portion 110 of the rack gear simultaneously or concurrently with the contact of the unmodified portion of the gear teeth forming the flat planar surface and the toothed portion of the irregular profile configuration 84 on the rack gear (see FIG. 23A). As indicated above, one or more gear wheels 38 and rack gears 36 having the features above may be used alone or in combination for purposes of the present invention.

Advantageously, the combination of the flat planar surface 98 of the gear wheel or spur gear and the arched portion 110 of the irregular tooth configuration 84 of the rack gear 36 insures proper timing of the initial assembly of the rack and pinion system and/or associated drawer assembly. Namely, when the flat portion 98 of the gear wheel 38 reaches the arched section 110 of the irregular tooth configuration 84, an interaction occurs, namely, the failure of these surfaces to align, causing the movement of the assembly to stop if the gears are not properly timed, or aligned. Specifically, a full profile gear wheel tooth 74 cannot be received by the irregular tooth configuration 84 on the rack gear. In other words, a drawer assembly comprising a rack and pinion stabilizer system as described above, when pushed inward into the cabinet will be stopped prior to complete insertion, and prevented from moving further inward as a result of the interaction between the irregular tooth configuration 84 and the gear wheel having a flat planar surface 98. As a result, the user will be required to remove and realign the assembly. On the other hand, if the gear assembly is properly timed and aligned, the flat planar surface 98 of the gear wheel 38 will contact and may move across the arched portion 110 of the rack gear 36, and continue the linear, rotational motion of the gear wheel along the rack gear. As a result, this system serves as a check for proper alignment and timing of the rack and pinion stabilizer system and/or the drawer assembly.

Figure 28:
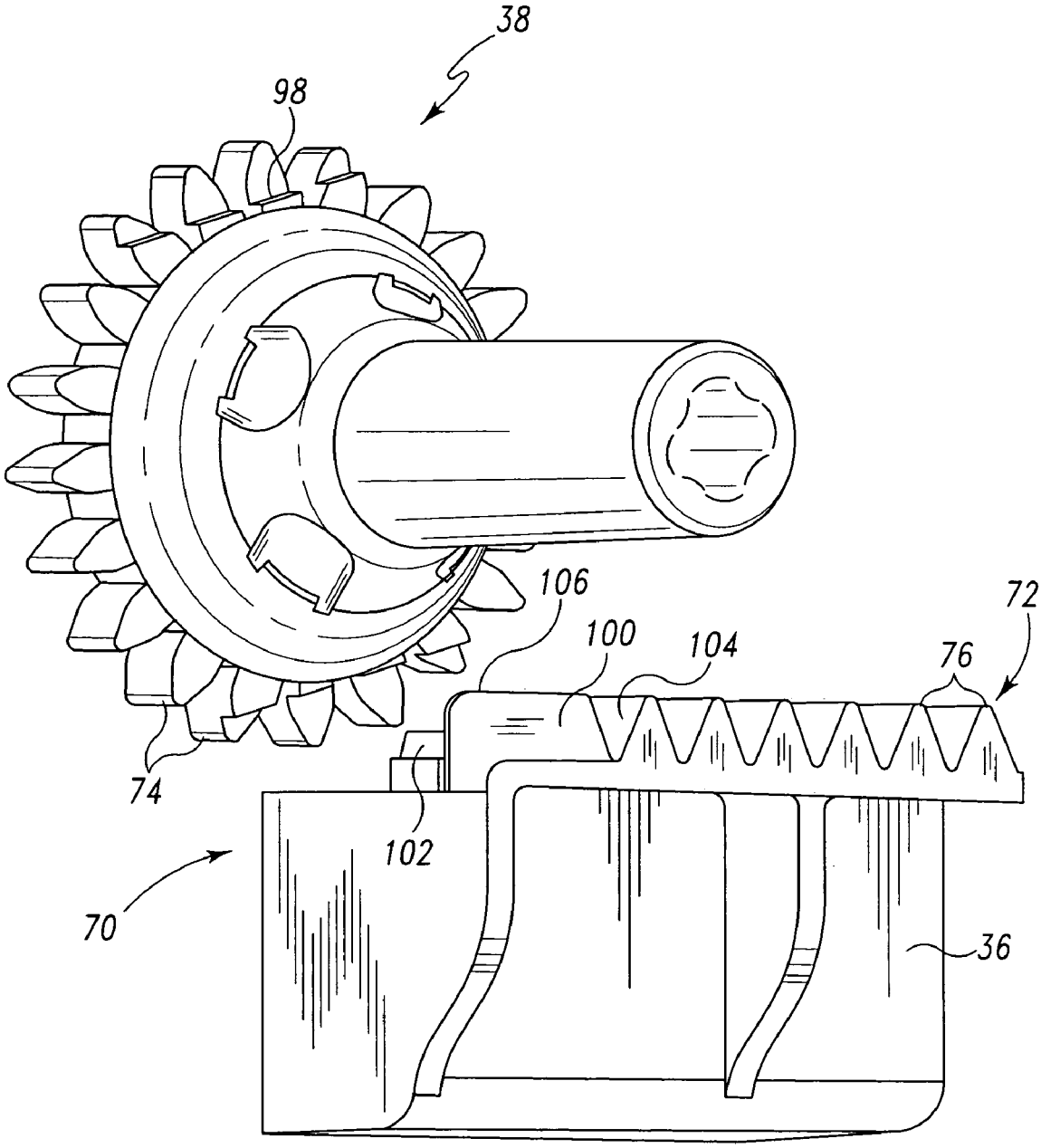
FIG. 28 is a cut away front perspective view of a rack and pinion system of an embodiment of the present invention having an alignment mechanism.

A rack and pinion alignment mechanism may also be provided to the assembly of the present invention. As shown in FIGS. 18, 19, 23A and 28, the spur gear 38 or gear wheel may be configured with at least one flat surface 98 created by altering the geometry of four adjacent teeth 74. As discussed, in one embodiment, the gear wheel 38 may include two such flat surfaces 98. Thus, four adjacent spur gear teeth are modified to form a planar surface 98. As will be discussed more fully below, the planar surface 98 provides a contact surface for mating with, or resting on, the top surface 106 of the alignment wall 100 of the rack gear 36. While four teeth are specifically discussed herein, one, two, three, four or more teeth may be modified or used to accomplish the purposes provided herein. Preferably, each of the four adjacent spur gear teeth 74 forming the planar surface 98 may include a portion comprising an unmodified gear tooth having a height and profile corresponding with the standard or common gear teeth surrounding the remainder of the circumference of the spur gear. Each of the four adjacent spur gear teeth 74 may further comprise an alignment portion or planar surface 98 having a reduced height and a flat top surface. Thus, a single gear tooth 74 comprises, for example, a complete gear tooth peak and a flat contact surface corresponding with the alignment portion. Due to the circular form of the spur gear 38, in order to create a planar surface 98 across multiple adjacent gear teeth 74, the alignment portions of the outer spur gear teeth extend above the alignment portions of the central gear teeth. Furthermore, the flat surface of each alignment portion is angled toward the adjacent gear tooth having an alignment portion, so as to create a planar surface across the four adjacent teeth on a circular gear, as can be seen in FIGS. 23A & 28.

As shown in FIGS. 15, 22A, 22B & 28, the rack gear portion 36 of the alignment mechanism 70 comprises an alignment wall section 100 and an initial tooth 102 of reduced height relative to the standard or common rack tooth 76 provided on at least a majority of the rack gear 36. The alignment wall section 100 comprises a flat surface across the top thereof for engagement with the corresponding flat or planar surface 98 of the spur gear 38 alignment portion or planar surface 98. In one embodiment, the alignment wall 100 comprises an upwardly extending plate with an alignment portion contact surface on the top thereof. A partial rack tooth 102 is positioned adjacent the alignment wall 100 for engaging the corresponding spur gear tooth 74.

Referring to FIG. 28, as the spur gear 38 approaches the rack gear 36, the two flat surfaces of the alignment wall 100 and the spur gear alignment portion 98 align to create a parallel condition. When the two surfaces 100, 98 are in a parallel condition, rotation of the spur gear 38 is prohibited. Instead, as the drawer is pushed into the cabinet, the spur gear alignment portion 98 slides along the alignment wall 100 of the rack gear 36. Spur gear 38 rotation is constrained until the first tooth of the flat section 98 has traveled beyond the rack gear alignment wall 100. At this point, the first flat-sided spur gear tooth impacts the first full or unmodified tooth 104 of the rack gear 36. In approximate concurrency, the second flat-sided spur gear tooth impacts the half or reduced height tooth 102 of the rack gear 36. As a result, the spur gear 38 must rotate to continue its linear motion toward the rear of the cabinet.

Figure 15:
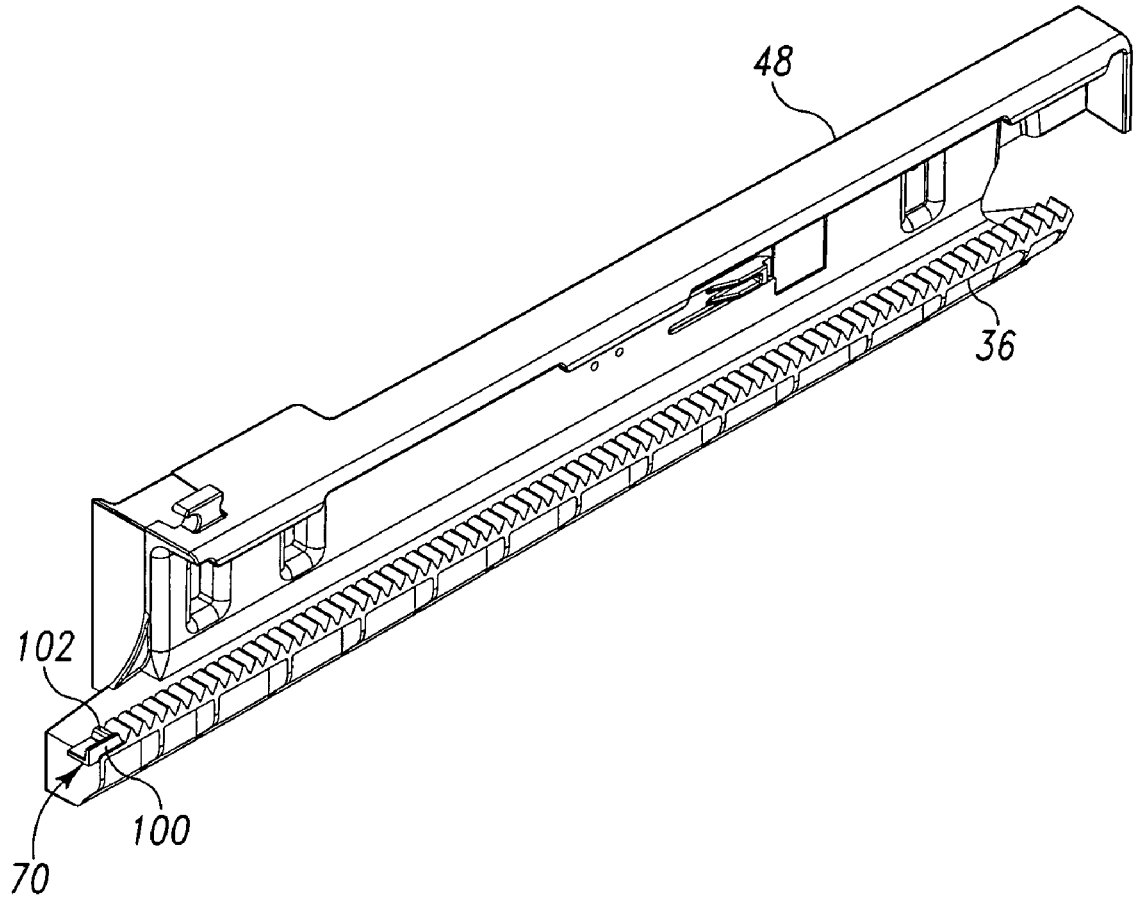
FIG. 15 is a perspective view of a cabinet attachment means and a rack gear of a rack and pinion stabilizer system in accordance with one embodiment of the present invention.

Referring to FIGS. 3, 8 and 15, the alignment system 70 is positioned at the forward end of the rack gear 36, and preferably extends beyond the slide assemblies 30. As a result, the drawer operator must correctly engage the alignment system 70 in order for the drawer 50 to slide inwardly upon initial installation of the drawer 50. An alignment mechanism 70 may be provided on one or both the first and second rack and pinion stabilizer system assemblies. Considering that each of the first and second spur gears 38 and rack gears 36 have identical alignment contact points, the gears are accurately aligned upon initial assembly, preventing drawer rack as the gears 38 rotate back towards the closed position of the drawer 50. Furthermore, the failure to engage the alignment mechanism 70 correctly results in a drawer rack, preventing the operator from moving the drawer 50 further inward. Proper timing for the system is thus established at the time of assembly. Therefore, the likelihood that the drawer 50 will be misaligned when fully inserted is significantly diminished.

Accordingly, in a preferred embodiment a combination of sub-assemblies of the rack and pinion stabilizer system is provided. As one example, referring to FIGS. 8 and 22B, a rack and pinion assembly may comprise one or more alignment mechanisms 70 positioned on the forward end of one or more rack gears 36. The assembly may further comprise one or more irregular rack tooth configurations 84 having an arched portion 110 and a toothed portion 112. In one embodiment, the assembly may also comprise one or more irregular profile rack teeth 80 for assembly variation uptake. One or more gear wheels 38 having modified gear teeth including a flat planar portion 98 may also be provided for mating engagement with the rack gears 36. An axle 40 may also be provided connecting a pair of gear wheels 38 for the uniform rotation thereof. In operation, the gear wheels 38 having a flat planar section 98 are aligned with the rack gears 36 by engaging the flat planar sections 98 of the gear wheels with the alignment mechanisms 70 provided at the forward end of the rack gears. The assembly is pushed inward beginning the rotation of the gear wheels 38 in unison across the rack gears 38 until the irregular rack tooth configuration 84 having an arched portion 110 is reached. If properly timed and/or aligned, the flat planar portions 98 of the gear wheels 38 contact the arched portions 110 of the racks, and continue the rotation of the gear wheels. If not properly aligned, further movement of the assembly inward is stopped, serving as a check of the alignment of the system. A properly aligned assembly continues its movement inward until the assembly is fully pushed inward, as described above. In this position, the gear wheels 38 may be positioned over one or more rack teeth having irregular profiles 80, which permit assembly variation uptake and complete closure of a drawer assembly when attached. While a specific combination of sub-assemblies is described above, various combinations of the sub-assemblies described herein may be used herein to accomplish the purposes of the present invention.

Briefly, a method of assembling an embodiment of the rack and pinion stabilizer system 34 of the present invention is as follows. The method is described in relation to using the rack and pinion stabilizer system 34 with a refrigeration unit. As discussed above, the system may alternatively be used with refrigerator drawers, baskets or shelves, as well as other cabinets and appliances where racking, wobble and misalignment are a concern and the method may vary somewhat accordingly. Each cabinet attachment member 48 having an outer channel member 46 may be fastened to a liner wall of the refrigerator. In one embodiment, the first cabinet attachment member 48 has a first outer channel member 46 and is fastened or secured to a first sidewall of the refrigerator liner. The second cabinet attachment member 48 has a second outer channel member 46 and is fastened or secured to a second sidewall of the refrigerator liner opposite the first outer channel member 46. Alternatively, the cabinet attachment members 48 and/or outer channel members 46 may be molded integrally with the liner. In such embodiment, no attachment of the outer channel member to the liner is required. In embodiments requiring fastening, the channel attachment members 48 and/or outer channel members 46 may be fastened and/or secured by any suitable means.

A first rack gear 36 is fastened to the outer channel member 46, the cabinet attachment member 48, and/or the liner wall in the positions described hereinabove. Likewise, a second rack gear 36 is fastened opposite the first rack gear 36. The rack gears 36 may, alternatively, be molded integrally with the respective outer channel member 46, cabinet attachment member 48, or other suitable component. The first intermediate slide member 44 is provided in slidable engagement, and is telescopically received within, the first outer channel member 46. The second intermediate slide member 44 is provided in slidable engagement, and is telescopically received within, the second outer channel member 46. The first intermediate slide member 44 and the second intermediate slide member 44 are thus positioned opposite one another. The first inner slide member 42 is provided in slidable engagement, and is telescopically received within, the first intermediate slide member 44. The second inner slide member 42 is provided in slidable engagement, and is telescopically received within, the second intermediate slide member 44. The first inner slide member 42 and the second inner slide member 42 are thus positioned opposite one another.

Bushings 82 may be fastened to, or may be molded integrally with the center of an inner facing surface of the first and second slide assemblies 30. As shown in FIG. 25, the bushing 82 may be fixed to the inner slide member 42. The bushing 82 provides a means of attaching the gear to the slide assembly. In one embodiment, the bushing 82 may be attached to the inner slide member 42 via snapping of a snap fit connection. The corresponding gear wheel 38 may comprise its own axle (integral or attached separately) separate from the drive shaft axle 40. The gear wheel axle is attached in the center of the gear wheel 38. In addition, a series of snaps, for example four snap fit connections, or connection means may be provided around at least one side of the gear wheel for fastening the gear wheel 38 to the bushing 82. The gear and drive shaft may be assembled with the gear wheels 38 extending outwardly to extend to snap to the bushings 82. In one embodiment, one side of the drive shaft 40 is pressed into a gear wheel 38. The opposite side may be a slide connection with the gear wheel 38. The gear wheels 38 may be fastened to the drive shaft 40 with the drive shaft receptor. The bushings 82 may alternatively be assembled directly or molded to the drive shaft axle 40. However, any means and/or location of attachment may be used without departing from the overall scope of the present invention. The drive shaft may be of sufficient length for the combined gear wheel and drive shaft axle assembly to extend perpendicularly from the first rack gear 36 to the second rack gear 36.

A first casing 90 with a gear wheel housing 96 is provided, and may be fastened to and/or cover at least a portion of the first slide member 30 when the drawer assembly is attached. A second casing 90 with gear wheel housing 96 is provided, and may be fastened to and/or cover the second slide assembly 30 opposite the first casing 90 when the drawer is attached.

A drawer 50 or basket is provided, and fastened to the first and second casings 90 and/or to the drive shaft axle 40 by any suitable means to support the drawer 50. Alternatively, the drawer 50 may be hung from supporting channels 92 or slots provided in the casings 90 or slide assemblies 30 on each side of the drawer 50. The front of the basket may be provided with a pair of front wall supports in the case of a bottom-mount freezer drawer, and a front wall attached thereto.

The gear wheel assembly in combination with the drawer 50 or basket is placed in rolling contact with the rack gears 36. The outer rim surface of the first gear wheel is placed in rolling contact with the top surface of the first rack gear, and the outer rim surface of the second gear wheel is placed in rolling contact with the top surface of the second gear rack. The position of the first and second gear wheels 38 are aligned in parallel to one another by the perpendicularly extending drive shaft axle 40 between the two gears. In an embodiment comprising an alignment mechanism 70, as the first and second gear wheels 38 approach the rack gear 36, the flat surfaces 98 of the alignment portion of the gear wheel 38 and the alignment wall 100 of the rack gear 36 align to create a parallel condition. As the drawer 50 is pushed into the cabinet, spur gear rotation is constrained until the first tooth of the flat section 98 has traveled beyond the rack gear alignment wall 100. At this point, the first flat-sided spur gear tooth impacts the first full tooth 76 of the rack gear 36. In approximate concurrency, the second flat-sided spur gear tooth impacts the half or reduced height tooth 102 of the rack gear 36. As a result, the spur gear 38 rotates to continue its linear motion towards the rear of the cabinet. Once the drawer 50 and attached rack and pinion system are aligned, the drawer is pushed inwardly to its fully closed position. The irregular tooth profile, if provided on the rack gear and/or the use of an angular slip spur gear, permits complete closure of the drawer in the event of variation in alignment.

While a particular method of assembling the present invention is provided, the invention is not limited thereto, and other combinations of the various elements, sub-assemblies, and steps may be used to create the rack and pinion stabilizer system in accordance with the present invention.

Briefly, the method of using the rack and pinion stabilizer system of the present invention is as follows. A user or manufacturer initially assembles the device in a manner similar to that described above. In an embodiment comprising alignment mechanisms, the user inserts a drawer having a gear wheel and axle assembly into a refrigerator cabinet having right and left slide assemblies with associated rack gears, which assemblies have been described above. Upon clearing the alignment mechanism 70, as described above, the drawer may be pushed into the cabinet. Thus, once the drawer and attached rack and pinion stabilizer system are aligned, the drawer is pushed inwardly to its fully closed position. During closure of the drawer, the gear wheels 38 rotate in unison along the rack gear 36 toward the rear of the cabinet. At the same time, the slide assemblies 42, 44 are telescopically received within the outer channel members 46. Upon complete closure of the drawer 50, the gear wheels 38 reach the terminal end of the rack gear 36. As previously described, an irregular rack gear tooth profile and/or an angular slip spur gear may be provided to impart a tolerance for slight forward and rearward movement of the gears, permitting closure of the drawer in the event of assembly variation in alignment. To extend the drawer 50, the user pulls the drawer or drawer handle, withdrawing the drawer from the cabinet. In connection with the movement of the drawer 50, the gear wheels 38 rotate in unison forwardly along the rack gears 36 toward the forward end of the rack gear 36. The gear wheels 38 may rotate forwardly until the end of the rack gear 36 is reached. At the same time, the slide assemblies 30 are extended to support the drawer 50 in the extended position. In this position, the user may access the contents of the drawer 50.

A combination of drawer glides, rack gears, alignment mechanism, gear wheels, and drive shaft axle provides a rack and pinion stabilizer system for a pullout drawer. The interaction of the pair of drawer glides having an associated rack gear and gear wheels (or rack and pinion) connected by a drive shaft axle, provides a mechanism for the drawer glides and associated gears to move in unison and resist lateral force that causes drawer rack, thereby stabilizing the drawer against rack or wobble as it is inserted and withdrawn from the cabinet. As the drawer is opened and closed, the motion of the first and second gear wheels is constrained in such a way that rotational, and therefore linear, velocities must be equal along the front face of the drawer. Furthermore, an alignment mechanism may be provided for controlling the insertion of the drawer. For example, irregular rack teeth may be provided as a means of maintaining alignment, and therefore the complete closure of the drawer within the refrigerator cabinet. As a result, the consumer is provided with a smooth operating drawer or basket for a refrigerator or other cabinet, and a simple means of aligning, and maintaining the alignment of the drawer without the risk of drawer rack.

The various mechanisms for the rack and pinion stabilizer system disclosed herein may be combined in numerous combinations, and the invention should not be limited to the particular combinations described and illustrated herein.

Several embodiments of the present invention and many of its improvements have been described with a degree of particularity. The previous description of examples for implementing the invention, and the scope of the invention should not be limited by this description. Persons skilled in the art will recognize that changes may be made in form and detail without departing from the spirit and scope of the invention.

What is claimed is:

1. A rack and pinion assembly comprising:

first and second slide assemblies;

first and second elongated rack gears each having forward and rearward ends defining a longitudinal axis with a plurality of rack teeth therebetween, the rack gears being positioned near the first and second slide assemblies and at least one of the first and second rack gears including a front alignment wall with a flat top surface and a front rack tooth having an irregular tooth configuration comprising a reduced tooth height with respect to one or more of the plurality of rack teeth; and first and second rotatable gear wheels in operable communication with the first and second rack gears respectively, at least one of the rotatable gear wheels comprising an outside face and a notched inside face for longitudinally mating with the alignment wall to align the first and second rack gears with the gear wheels when the gear wheels are assembled longitudinally from the forward ends onto the rack gears.

2. The rack and pinion assembly of claim 1, wherein the notched inside face of the rotatable gear wheel contacts the outside face of the rack gear concurrently with the contact of the outside face of the gear wheel with the inside face of the irregular tooth configuration on the rack gear.

3. The rack and pinion assembly of claim 1, wherein a plurality of irregular tooth configurations are provided on the one rack gear.

4. The rack and pinion assembly of claim 1, wherein the rack and pinion assembly is operably connected to a drawer assembly.

5. The rack and pinion assembly of claim 4, wherein the drawer assembly comprises a basket.

6. The rack and pinion assembly of claim 1, further comprising an axle operably connected to and aligning the first gear wheel and the second gear wheel, the axle constraining the rotational and linear velocities of the gear wheels.

7. The rack and pinion assembly of claim 1, wherein the rack and pinion assembly is housed in an appliance.

8. The rack and pinion assembly of claim 7, wherein the appliance is a refrigerator.

9. The rack and pinion assembly of claim 8, further comprising an operable connection to a freezer drawer.

10. The rack and pinion assembly of claim 8, wherein the refrigerator comprises:

a cabinet having an outer shell and a liner positioned within the outer shell;

first and second liner walls having the first and second slide assemblies and the first and second rack gears attached thereto; and a drawer assembly being positioned within the cabinet in operable communication with at least one of the slide assemblies and the rack gears.

11. The rack and pinion assembly of claim 10, wherein the first and second slide assemblies each comprise an inner slide member and an intermediate slide member, the inner slide member being telescopically received within the intermediate slide member.

12. The rack and pinion assembly of claim 11, further comprising first and second outer channel members, the intermediate slide members being telescopically received within an outer channel member, wherein the slide assemblies are attached to the first and second liner walls via attachment of the first and second outer channel members to the first and second liner walls.

13. The rack and pinion assembly of claim 12, wherein the first and second rack gears are attached to the first and second outer channel members, respectively, the first and second rack gears being attached to the first and second liner walls of the refrigerator via attachment of the first and second outer channel members to the first and second liner walls.

14. The rack and pinion assembly of claim 10, further comprising an axle operably connected to and aligning the first gear wheel and the second gear wheel, the axle constraining the rotational and linear velocities of the gear wheels, wherein the drawer assembly is in operable communication with at least one of the first and second slide assemblies and the axle.

15. The rack and pinion assembly of claim 1, wherein the first and second rotatable gear wheels comprise at least partially toothed wheels and wherein the first and second rack gears comprise at least partially toothed rods.

16. The rack and pinion assembly of claim 1, further comprising:

an axle operably connected to and aligning the first gear wheel and the second gear wheel, the axle constraining the rotational and linear velocities of the drawer; and at least one of the first and second rotatable gear wheels comprising an opening for receiving a portion of the axle and configured to allow a degree of angular slip over the axle within the opening, whereby a tolerance in the communication of at least one of the first and second gear wheels with the respective rack gear is provided.

17. The rack and pinion assembly of claim 1, wherein the outside rack face of the irregular tooth configuration of the at least one rack gear comprises an arched notch.

18. A rack and pinion assembly comprising:

first and second slide assemblies;

first and second rack gears each having forward and rearward ends defining a longitudinal axis, and being positioned near the first and second slide assemblies and at least one of the first and second rack gears including at least one rack tooth having an irregular tooth configuration comprising a rack toothed portion and an arched portion at a lower height than the rack toothed portion and comprising at least one rack gear having a final two teeth comprising a spacing that is greater than a common rack tooth profile;

first and second rotatable gear wheels in operable communication with the first and second rack gears respectively, at least one of the rotatable gear wheels comprising a gear wheel toothed portion and a planar surface at a lower height than the gear wheel toothed portion for mating with the irregular tooth configuration of the rack gear to create a condition confirming an alignment of the first and second rack gears with the gear wheels;

an axle operably connected to and aligning the first gear wheel and the second gear wheel, the axle constraining the rotational and linear velocities of the gear wheels; and an alignment wall section and an initial tooth of reduced height at the forward end of at least one of the first and second rack gears, wherein at least one of the rotatable gear wheels comprising a gear wheel planar surface capable of sliding longitudinally along the alignment wall section to create a parallel condition thereby aligning the first and second rack gears.

19. The rack and pinion assembly of claim 18, wherein the spacing comprises a gear tooth drive side having a first variance from a common gear tooth profile and a gear tooth idle-side having a second variance from a common gear tooth profile.

20. The rack and pinion assembly of claim 18, wherein the rack and pinion assembly is operably connected to a drawer assembly.

21. The rack and pinion assembly of claim 18, wherein the rack and pinion assembly is housed in an appliance.

22. The rack and pinion assembly of claim 21, wherein the appliance is a refrigerator.

23. The rack and pinion assembly of claim 18, wherein the toothed portion of the irregular tooth configuration has a common rack tooth profile.

24. An appliance having a drawer, the drawer having a rack and pinion assembly, the rack and pinion assembly comprising:

first and second slide assemblies;

first and second rack gears having forward and rearward ends and being positioned near the first and second slide assemblies and at least one of the first and second rack gears including at least one rack tooth having an irregular tooth configuration comprising an inside rack face having a common rack tooth profile and an outside rack face having an arched portion at a lower height than the inside rack face; and first and second rotatable gear wheels in operable communication with the first and second rack gears respectively, at least one of the rotatable gear wheels comprising an outside gear face and an inside gear face having a planar surface at a lower height than the outside gear face for longitudinal sliding engagement with the irregular tooth configuration of the rack gear to create a condition confirming an alignment of the first and second rack gears with the gear wheels as the gear wheels are assembled longitudinally onto the rack gears.

* * * * *